US006530642B1

(12) United States Patent
Uchikata et al.

(10) Patent No.: US 6,530,642 B1
(45) Date of Patent: Mar. 11, 2003

(54) CLEANING DEVICE, METHOD AND PRINTER WITH VIRTUALLY EQUAL WIPING CONDITION FOR DIFFERENT PRINT UNIT TO RECORDING SURFACE DISTANCES

(75) Inventors: Yoshio Uchikata, Yokohama (JP); Hisashi Ishikawa, Urayasu (JP); Hiroshi Tajika, Yokohama (JP); Miyuki Fujita, Tokyo (JP); Yuji Konno, Kawasaki (JP); Norihiro Kawatoko, Machida (JP); Tetsuya Edamura, Tama (JP); Tetsuhiro Maeda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/461,355

(22) Filed: Dec. 15, 1999

(30) Foreign Application Priority Data

Dec. 15, 1998 (JP) ..... 10-356581
May 7, 1999 (JP) ..... 11-127654

(51) Int. Cl.[7] ..... B41J 2/165
(52) U.S. Cl. ..... 347/33
(58) Field of Search ..... 347/33, 8, 17, 347/34

(56) References Cited

U.S. PATENT DOCUMENTS

| | | | | | |
|---|---|---|---|---|---|
| 4,340,897 | A | * | 7/1982 | Miller | 347/33 |
| 5,126,765 | A | * | 6/1992 | Nakamura | 347/33 |
| 5,170,184 | A | | 12/1992 | Hanabusa et al. | 346/134 |
| 5,266,974 | A | | 11/1993 | Koitabashi et al. | 347/33 |
| 5,555,461 | A | | 9/1996 | Ackerman | 347/33 |
| 5,606,354 | A | * | 2/1997 | Bekki et al. | 347/33 |
| 5,798,775 | A | | 8/1998 | Takahashi et al. | 347/33 |
| 6,000,775 | A | * | 12/1999 | Muraki | 347/8 |
| 6,015,203 | A | * | 1/2000 | Arai et al. | 347/33 |

FOREIGN PATENT DOCUMENTS

| | | |
|---|---|---|
| EP | 0 418 820 | 9/1989 |
| EP | 0 465 260 | 7/1990 |
| EP | 0 630 753 | 5/1994 |
| JP | 2-18055 | 1/1990 |
| JP | 2-198859 | 8/1990 |
| JP | 3-222753 | 10/1991 |
| JP | 3-222754 | 10/1991 |
| JP | 4-187445 | 7/1992 |
| JP | 5-254137 | 10/1993 |
| JP | 6-270413 | 9/1994 |
| JP | 7-125224 | 5/1995 |
| JP | 7-171967 | 7/1995 |
| JP | 7-205434 | 8/1995 |
| JP | 7-276620 | 10/1995 |
| JP | 8-20112 | 1/1996 |
| JP | 9-290511 | 11/1997 |
| JP | 10-138464 | 5/1998 |

OTHER PUBLICATIONS

EP Search Report dated Sep. 17, 2001.

* cited by examiner

*Primary Examiner*—Hai Pham
(74) *Attorney, Agent, or Firm*—Fitzpatrick, Cella, Harper & Scinto

(57) ABSTRACT

An ink jet printer includes a distance adjust mechanism for adjusting in two steps a distance between a liquid nozzle-formed face of a print unit and the recording surface, and a unit having first and second cleaning members with different free end positions, lengths and/or thicknesses are arranged movable relative to the face and adapted to wipe a substance adhering to the face off of the face with a predetermined engagement condition. The substance is wiped off of the face by the first and second cleaning members having different engagement conditions when the face is a first distance from a recording surface, and is wiped off with the engagement condition of a wipe portion of the first cleaning member virtually equal to the engagement condition of a wipe portion of the second cleaning member associated with the first distance when the face is a second distance from the medium. Further, a height difference between the cleaning members is set almost equal to the distance the face is moved by the distance adjust mechanism.

33 Claims, 30 Drawing Sheets

| AMOUNT OF ADHERING INK / CONTACT WIDTH | A | B | C | D | E |
|---|---|---|---|---|---|
| FIRST LEVEL | — | ○ | ○ | △ | × |
| SECOND LEVEL | — | ● | ● | ● | × |
| THIRD LEVEL | — | ● | △ | × | × |

FIG.27

CLEANING DEVICE, METHOD AND PRINTER WITH VIRTUALLY EQUAL WIPING CONDITION FOR DIFFERENT PRINT UNIT TO RECORDING SURFACE DISTANCES

This application is based on Patent Application No. 10-356581 (1998) filed Dec. 15, 1998 in Japan, and No. 11-127654 (1999) filed May 7, 1999 in Japan, the content of which is incorporated hereinto by reference.

BACKGROUND OF THE INVENTION

1. Field of the Invention

The present invention relates to a method of cleaning a liquid nozzle-formed face of a print unit that performs printing on a surface of a recording medium, to a cleaning device for an ink jet printing apparatus having a plurality of cleaning members using this cleaning method, and to an ink jet printing apparatus having this cleaning device.

2. Description of the Prior Art

Conventional ink jet printing apparatus are provided with a cleaning device for cleaning the surface of a print head formed with a plurality of ink nozzles because contamination of the nozzle-formed face will lead to a failure of the print head to eject ink. The cleaning device includes a wiper blade as a cleaning member. The wiper blade is made, for example, of an elastic material and is moved relative to the nozzle-formed face of the print head to bring its wipe portion into a sliding contact with the nozzle-formed face to remove ink adhering to it.

During this process, a cleaning performance (wiping performance) of the wiper blade depends on an ink adhesion state of the nozzle-formed face of the print head and a contact width over which the wipe portion of the wiper blade contacts the nozzle-formed face.

The result of verification as to the effect which the contact width between the wipe portion of the wiper blade and the nozzle-formed face has on the wiping performance will be described in the following.

FIG. 20 shows a state in which the end of the wiper blade 1004 is brought into contact with one surface of a transparent body 1002, such as a glass plate, of a predetermined width over a predetermined contact width Lc and is slid in a direction of arrow at a predetermined speed, for example 150 mm/s. The wiper blade 1004 is made of an elastic material (with Asca C scale hardness of 75) and is 10 mm in overall length and 0.7 mm in thickness.

In performing the verification, the contact width over which the wipe portion of the wiper blade 1004 contacts the nozzle-formed face is classified largely into three levels as shown in FIG. 21.

A first level of the contact width (overlapping length) Lc represents a state in which a contact width L1 is relatively small at about 0.3–0.7 mm when viewed directly from above, with only a widthwise edge of the end of the wipe portion in contact, as shown in FIG. 21A. A second level represents a state in which a contact width L2 is slightly larger at about 0.8–1.2 mm, with the widthwise edge as well as a widthwise area of the front surface of the wipe portion near its end in contact, as shown in FIG. 21B. A third level represents a state in which a thicker widthwise area of the front surface of the wipe portion near its end than in the second level contacts the transparent body over a relatively large contact width L3 of about 1.3–1.7 mm as shown in FIG. 21C.

The verification is performed by contacting the end of the wipe portion of one wiper blade 1004 against the nozzle-formed face of the print head over a predetermined contact width and sliding it in the direction of arrow at a predetermined speed of, for example, 150 mm/s. In this verification, the amount of ink adhering to the nozzle-formed face of the print head is set in five levels. For each level of ink adhesion to the nozzle-formed face, the contact width is changed in three levels.

The five levels set for the amount of adhering ink are: an initial ink adhesion state E in which ink adheres uniformly to the entire area of the nozzle-formed face of the print head with no apparent effect of the liquid repelling ability of the nozzle-formed face; an initial ink adhesion state D in which a significant number of large and small grains of ink adhere to the nozzle-formed face, like a state found when a relatively high density (50% or higher) recording has been performed; an initial ink adhesion state C in which ink grains are uniformly scattered on the nozzle-formed face, like a state found when a relatively intermediate density (10–50%) recording has been performed; an initial ink adhesion state B in which ink grains are sparsely present on the nozzle-formed face, like a state found when a relatively low density (less than 10%) recording has been carried out; and a state A in which no ink is present on the nozzle-formed face, like a state immediately after the print head has been replaced.

The result of this, verification is tabulated in FIG. 27. In FIG. 27, a solid black circular mark "●" indicates that the surface wiped by the wiper blade 1004 is in good condition; a white circular mark "○" indicates that a small amount of ink remains on the surface at positions spaced from the nozzles, with no adverse effect on the ink ejection performance; a triangular mark "Δ" indicates that a small amount of ink remains near the nozzles leaving the possibility of affecting the ink ejection performance; a cross mark "x" indicates that a large amount of ink remains near the nozzles, giving rise to the possibility of an ink ejection failure; and a bar mark "-" indicates that there is no remaining ink.

As is evident from the table of FIG. 27, keeping the contact width (overlapping length) at the second level or an intermediate length of 0.8–1.2 mm produces good wiping results for the initial ink adhesion levels B, C, D. As to the initial ink adhesion level E in which the ink cannot be repelled at all by the liquid repelling ability of the nozzle-formed face and remains over the entire area of the nozzle-formed face, however, there is a limit to what the single wiper blade can do in wiping off the adhering ink.

Further, as shown in FIG. 22A, when the nozzle-formed face 1008*s* of the print head 1008 has been wiped a plurality of times by the wiper blade 1010 supported on a support mount 1012, the wiping action is likely to be started with contaminating ink droplets 1006 adhering to the wipe portion of the wiper blade 1010.

In that case, when the wiping is performed by the wiper blade 1010 with the contact width set to a relatively large amount, the dirty ink droplets 1006 are rubbed against the nozzle-formed face 1008*s* by the wiper blade 1010, as shown in FIG. 22B. After the wiping operation, the dirty ink droplets 1006 adhere to the entire area of the wipe portion of the wiper blade 1010, as shown in FIG. 22C.

Hence, the nozzle-formed face 1008*s* is likely to be smeared with the dirty ink droplets 1006.

FIG. 23 shows the wipe portion (engagement surface) of the wiper blade 1016 wiping the nozzle-formed face 1014*s* of the print head 1014 having rows of nozzles 1018X, 1018Y and 1018Z in such a manner that the wipe portion has a predetermined contact width. The nozzle rows 1018X, 1018Y and 1018Z are arranged parallel to each other at predetermined intervals in the scan direction of the print head 1014, i.e., in the direction of arrow in FIG. 23. The print head 1014 is moved toward the scan direction indicated by the arrow of FIG. 23 relative to the wipe portion of the fixed wiper blade 1016. In FIGS. 24 and 25 described later, ink already adhering to the nozzle-formed face 1014*s* is not shown.

When the wipe portion (engagement surface) of the wiper blade 1016, after passing the nozzle row 1018Z in the nozzle-formed face 1014*s* while wiping off the adhering ink as shown in FIG. 24A, reaches the nozzle row 1018Y as shown in FIGS. 24B and 25A, a part (meniscus ME) of the ink 1020 in the nozzle row 1018Y is drawn out in the direction of arrow as shown in FIG. 25B by a capillary attraction generated in a minute clearance CL between the end face of the wiper blade 1016 and the nozzle row 1018Y in the nozzle-formed face 1014*s*.

Then, the wipe portion (engagement surface) of the wiper blade 1016 moves past the nozzle row 1018Y in the nozzle-formed face 1014*s* and advances further toward the direction of arrow, wiping the adhering ink, as shown in FIGS. 24C and 25C. The ink 1020 is attracted by the capillary attraction to both of the front face, with respect to the moving direction, of the wiper blade 1016 near its end and the rear face opposite the front face and is carried by the blade in the direction of arrow.

In this case, when the contact width of the end portion of the wiper blade 1016 is set to the second level and the nozzle-formed face 1014*s* is given a liquid repelling treatment, the ink 1020 is carried relatively smoothly.

When the contact width of the wipe portion of the wiper blade 1016 is set to the first level, the contact force of the tip portion is relatively weak, so that ink may remain on the nozzle-formed face 1014*s* after the surface is wiped by the wiper blade 1016 although there is no possibility of the remaining ink adversely affecting the ink ejection performance. When the contact width of the wipe portion of the wiper blade 1016 is set to the third level, the contact state of the engagement surface of the wiper blade 1016 becomes unstable rendering the wiping action uneven (i.e., sticking and slipping occur), with the result that the ink may remain on the nozzle-formed face 1014*s*.

When the relative moving speed of the wipe portion of the wiper blade 1016 is relatively slow (less than 50 mm/s), the amount of a part (meniscus ME) of the ink 1020 in the nozzle row 1018Y drawn out in the direction of arrow as shown in FIG. 25B becomes excessive, so that the ink may remain on the nozzle-formed face 1014*s*. Even where the relative moving speed of the wipe portion of the wiper blade 1016 is relatively high, as the wipe portion of the wiper blade 1016 moves in the direction of arrow wiping the ink 1020 as shown in FIG. 26A, the ink 1020 adhering to the front face, with respect to the moving direction, of the tip portion of the wiper blade 1016 may get through between the nozzle-formed face 1014*s* and the engagement surface of the blade tip to remain on the nozzle-formed face 1014*s*, as shown in FIG. 26B.

Because there is a limit to what a single wiper blade can accomplish in eliminating the problems, such as the ink on the wiper blade in turn smearing the nozzle-formed face and the ink slipping through to the rear face, it is proposed, as in Japanese Patent Application Laid-Open No. 5-254137 (1993), that blade members of the same shape are arranged opposed to each other at a predetermined interval.

In this arrangement, the nozzle-formed face of the print head approaches the wipe portion of one of the two blade members from one direction so that the wiped ink adheres mostly to the one blade member. This prevents the wiped ink from attaching to the other blade member.

Further, as described in Japanese Patent Application Laid-Open No. 7-205434 (1995) and in FIG. 28, it is also proposed that blade members with different length and different hardnesses are opposed to each other at a predetermined interval.

In FIG. 28 representing this proposal, two wiper blades 1024 and 1026 for wiping the nozzle-formed face 1028*s* of the print head 1028 are arranged parallel to each other on the same plane of a support mount 1030. The support mount 1030 is placed, for example, on the moving path of the print head 1028. The wiper blades 1024 and 1026 have different lengths.

The thin plate-like wiper blades 1024 and 1026 have the same thicknesses and are wide in a direction almost perpendicular to the direction of arrow in FIG. 28, i.e., to the scan direction of the print head 1028. The contact width over which the wipe portion of the wiper blade 1024 contacts the nozzle-formed face 1028s is set larger than the contact width over which the wiper blade 1026 contacts the nozzle-formed face 1028*s*. The contact width of the wiper blade 1024 is set at about 1.5 mm for example, while the contact width of the wipe portion of the wiper blade 1026 is set at about 0.7 mm. The interval between the wiper blades 1024 and 1026 is such that they do not interfere with each other.

With the tip portion of the wiper blade 1026 engaged at a predetermined angle with a relatively large contact force, the wiper blade 1026 first removes ink adhering to the nozzle-formed face 1028*s*. The wiper blade 1024 is engaged against the nozzle-formed face 1028*s* with a smaller contact force than that of the wiper blade 1026 to remove the ink that escaped being wiped off by the wiper blade 1026 and the ink that was drawn out from the nozzles.

This ensures that the ink that has slipped through to the rear side of the wiper blade 1026 and the ink drawn out from the nozzles are wiped away by the wiper blade 1024.

To obtain a clear and crisp image quality in the ink jet printing apparatus, it is advantageous if the gap between the nozzle-formed face of the print head and the surface of the recording medium is relatively small at about 1 mm, considering the precision of ink droplet landing position.

Where the recording medium used is so-called plain paper with no special surface treatment, other than coated paper and film with a special surface treatment, when the amount of ink ejected is relatively large (high duty printing), there is a possibility of rubbing between the recording surface and the nozzle-formed face due to cockling, making it necessary to set the gap between the nozzle-formed face of the print head and the surface of the recording medium relatively wide.

Also where the recording medium is relatively thick, the gap between the nozzle-formed face of the print head and the surface of the recording medium may need to be set relatively wide for proper printing.

To avoid contact between the nozzle-formed face of the print head and the surface of the recording medium, there is known an apparatus which has a distance adjust mechanism that can change the distance between the nozzle-formed face of the print head and the surface of the recording medium according to the thickness of the recording medium.

(1) In the configuration having the wiper blades 1024, 1026, when the distance adjust mechanism changes the distance between the nozzle-formed face of the print head and the surface of the recording medium by about 0.5 mm from a relatively narrow distance indicated by a two-dot chain line in FIG. 28 to a relatively wide distance indicated by a one-dot chain line, the contact width of the wiper blade 1026 decreases to as small as about 0.7 mm or less, which means that a sufficient contact width may not be secured.

When the distance between the nozzle-formed face of the print head and the surface of the recording medium is set relatively narrow as indicated by the two-dot chain line in FIG. 28 and the contact width over which the wiper blade 1024 contacts the nozzle-formed face 1028*s* is set to about 1.5 mm, the wiper blade 1024 contaminated through performing the wiping action a plurality of times may smear the nozzle-formed face 1028*s*.

Considering these problems, it is a first object of the present invention to provide a cleaning method, a cleaning device of an ink jet printing apparatus using this cleaning method, and an ink jet printing apparatus having this cleaning device, in which, even when the distance between the liquid nozzle-formed face of the print head and the recording surface of the recording medium is changed, the contact widths of the cleaning members can be made appropriate values according to the distance.

(2) In the ink jet printing apparatus, there is a demand that the printing operation be able to be performed to produce a good print quality on the recording surface of the recording medium at a relatively high speed and inexpensively according to data representing characters and images.

To print characters at high speed, it is required that the number of nozzles in the print head be increased to expand the printing width per unit time and that the printing be performed at an appropriate resolution (300–600 dpi). At this time, the average print ratio per unit area in the character region (average print duty) is relatively low, for example, at about 5–10%. When an image, particularly a picture that requires smooth gradation of tone, is to be printed in good condition, the granular feel, gray scale and uniformity (no variation in density) need to be balanced. To meet this requirement, an effort has been made to reduce the amount of ink injected and the average print duty is set at about 10–40%.

Thus, the print head must be optimized according to the images or characters to be formed. The measures proposed to meet this requirement include a system that mounts both a character-dedicated print head and an image-dedicated print head, and a system that allows the use of either the character-dedicated print head or the image-dedicated print head through replacement.

During printing, the condition in which the ink adheres to the nozzle-formed face of the print head (wettability) varies according to, for example, the average print duty value mentioned above and the distance between the nozzle-formed face of the print head and the surface of the recording medium, as shown in FIGS. 29 and 30.

FIG. 29B shows the nozzle-formed face RHES of the print head RHE opposed to the recording surface of the recording medium Pa at a relatively wide distance La. In this arrangement, ink droplets IDa are shown to be ejected from a plurality of nozzles nO onto the recording surface of the recording medium Pa in such a way that the average print duty value is relatively small.

The plurality of nozzles nO, as shown in FIG. 29A, are arranged in the nozzle-formed face RHES in a direction almost perpendicular to the direction S of movement of the print head RHE.

In this case, as shown in FIGS. 29A and 29B, after an ink droplet IDa has landed the recording surface, a part of the droplet is scattered, directly adhering to the nozzle-formed face RHES or forming ink mist which in turn sticks to the nozzle-formed face RHES. These adhering ink particles are shown at IDa'. The sizes of these ink particles IDa' are relatively small and the amount of adhering ink IDa' is also relatively small.

FIG. 30B, on the other hand, shows the nozzle-formed face RHES' of the print head RHE' opposed to the recording surface of the recording medium Pa at a relatively narrow distance Lb, which is shorter than the distance La. In this arrangement, ink droplets IDb are shown to be ejected from a plurality of nozzles nO onto the recording surface of the recording medium Pa in such a manner that the average print duty value is relatively large. In FIGS. 30A and 30B the constitutional elements identical with those of FIGS. 29A and 29B are assigned like reference numbers and their explanations are omitted.

In this case, as shown in FIGS. 30A and 30B, after the ink droplet IDb has landed the recording surface, a part of the droplet is scattered, directly adhering to the nozzle-formed face RHES' or forming ink mist which in turn sticks to the nozzle-formed face RHES'. These adhering ink particles are shown at IDb'. The sizes of these ink particles IDb' are relatively large and the amount of adhering ink IDb' is also relatively large.

Therefore, when the print head RHE used is a monochromatic head and the print head RHE' is a color head, the optimum wiping should be performed for each print head. However, there are no printing apparatus that perform wiping in a manner that considers the wiping conditions of the print heads with different average print duty values.

Considering these problems, it is a second object of the present invention to provide a cleaning method, a cleaning device of an ink jet printing apparatus using this cleaning method, and an ink jet printing apparatus having this cleaning device, which can clean the liquid nozzle-formed face of the print unit under the wiping conditions suited for the print heads with different average print duty values.

(3) The ink jet printing apparatus conventionally uses similar dye-based inks of, for example, black, cyan, magenta and yellow colors in forming a color image on the recording surface of the recording medium. These inks may be changed in their composition in order to compensate for variations in the durability of the print head due to the charring of the print head heaters resulting from the difference in the kind of dye.

Further, recent years have seen an increasing tendency that a pigment-based inks rather than dye-based inks are used as black ink because characters formed on the recording surface are required to have water resistance. The pigment-based inks may lead to an ink ejection failure particularly when it adheres to the nozzle-formed face of the print head, and therefore it is necessary to remove the adhering ink thoroughly.

The pigment-based inks, however, are generally not easily dissolved again, compared with the dye-based inks, and because the properties of these inks such as viscosity and surface tension are different from those of the dye-based ink, it is difficult to reliably wipe off both the pigment-based ink and dye-based ink adhering to the nozzle-formed face of the print head at one time.

Considering these problems, it is a third object of the present invention to provide a cleaning method, a cleaning device of an ink jet printing apparatus using this cleaning method, and an ink jet printing apparatus having this cleaning device, which can reliably clean the liquid nozzle-formed face of the print unit, designed to perform printing on the recording surface of the recording medium, under the wiping condition suited for the dye ink and the pigment ink used for printing.

Further, to solve these conventional problems, it is a fourth object of the present invention to provide an ink jet printing apparatus in which the distance from the print head to the recording medium can be selectively changed and the print head is wiped by a plurality of cleaning members that correspond to the position of the print head and have different free end positions, thereby assuring good wiping and good print quality at all times without loading the print head and carriage regardless of the selected position of the print head.

SUMMARY OF THE INVENTION (1) To achieve the first object described above, the cleaning method according to this invention comprises the steps of: when a distance between a liquid nozzle-formed face of a print unit, which performs printing on a recording surface of a recording medium, and the recording surface is adjusted to a first distance, wiping off a substance adhering to the liquid nozzle-formed face by a first cleaning member and then by a second cleaning member, the first cleaning member being arranged movable relative to the liquid nozzle-formed face of the print unit, the second cleaning member being adapted to wipe off the substance adhering to the liquid nozzle-formed face following the first cleaning member, the first and second cleaning members having different contact widths; and when the distance between the liquid nozzle-formed face of the print unit and the recording surface is adjusted to a second distance, larger than the first distance, setting the contact width of a wipe portion of the first cleaning member virtually equal to the contact width of a wipe portion of the second cleaning member associated with the first distance and wiping off the adhering substance.

The cleaning device of the ink jet printing apparatus according to the invention comprises: a cleaning member unit, the cleaning member unit further comprising: a distance adjust mechanism for adjusting in two steps a distance between a liquid nozzle-formed face of a print unit, which performs printing on a recording surface of a recording medium, and the recording surface; a first cleaning member arranged movable relative to the liquid nozzle-formed face of the print unit and adapted to wipe off with a predetermined contact width a substance adhering to the liquid nozzle-formed face; and a second cleaning member for wiping off with a predetermined contact width the substance adhering to the liquid nozzle-formed face following the first cleaning member; wherein the contact width of the wipe portion of the second cleaning member obtained when the distance between the liquid nozzle-formed face of the print unit and the recording surface is adjusted to a first distance by the distance adjust mechanism is set almost equal to the contact width of the wipe portion of the first cleaning member obtained when the distance is adjusted to a second distance, larger than the first distance.

(2) To achieve the second object, the cleaning method according to the invention is characterized in that, in the above cleaning method, the contact widths of the wipe portions of the first cleaning member and the second cleaning member are individually set based on the amount of substance adhering to the liquid nozzle-formed face of the print unit and on the distance between the liquid nozzle-formed face of the print unit and the recording surface in such a manner that a wiping state of at least one of the wipe portions of the first cleaning member and the second cleaning member differs from a wiping state of the other.

The cleaning device of the ink jet printing apparatus according to the invention is characterized in that, in the cleaning device described above, the contact widths of the wipe portions of the first cleaning member and the second cleaning member are individually set based on the amount of substance adhering to the liquid nozzle-formed face of the print unit and on the distance between the liquid nozzle-formed face of the print unit and the recording surface in such a manner that a wiping state of at least one of the wipe portions of the first cleaning member and the second cleaning member differs from a wiping state of the other.

(3) To achieve the third object, the cleaning method according to the invention is characterized in that, in the cleaning method described above, the contact widths of the wipe portions of the first cleaning member and the second cleaning member are individually set based on a dye ink or a pigment ink adhering to the liquid nozzle-formed face of the print unit and on the distance between the liquid nozzle-formed face of the print unit and the recording surface in such a manner that a wiping state of at least one of the wipe portions of the first cleaning member and the second cleaning member differs from a wiping state of the other.

The cleaning device of the ink jet printing apparatus according to the invention is characterized in that, in the cleaning device described above, the contact widths of the wipe portions of the first cleaning member and the second cleaning member are individually set based on a dye ink or a pigment ink adhering to the liquid nozzle-formed face of the print unit and on the distance between the liquid nozzle-formed face of the print unit and the recording surface in such a manner that a wiping state of at least one of the wipe portions of the first cleaning member and the second cleaning member differs from a wiping state of the other.

(4) To achieve the fourth object, the ink jet printing apparatus according to the invention is characterized in that the distance from the print head to the recording medium can be selectively changed and the print head is wiped by a plurality of wiper blades as cleaning members that correspond to the position of the print head and have different free end positions, thereby assuring good wiping and good print quality at all times without loading the print head and carriage regardless of the selected position of the print head.

Further, the ink jet printing apparatus according to the invention is characterized by a print means for ejecting ink from nozzles onto a recording medium for printing; an ejection recovery means for recovering the ejection performance by engaging the print means; a selector mechanism for selecting a distance between the print head and the recording medium; and a cleaning means having a plurality of cleaning members, the cleaning members having different free end positions according to the distance between the print head and the recording medium.

The ink jet printing apparatus according to the invention is characterized in that the free ends of the plurality of the cleaning members are positioned so that the forces of the cleaning members when they engage the print head are virtually equal among the cleaning members.

The ink jet printing apparatus according to the invention is characterized in that the free ends of the plurality of the cleaning members are positioned so that the deflections of the cleaning members when they engage the print head are virtually equal among the cleaning members.

Further, the ink jet printing apparatus according to the invention is characterized in that the free ends of the plurality of the cleaning members are positioned so that the engagement angles of the cleaning members when they engage the print head are virtually equal among the cleaning members.

Further, the ink jet printing apparatus according to the invention is characterized by a selector mechanism for selecting the distance between the print head and the recording medium and by the plurality of the cleaning members with different lengths according to the distance between the print head and the recording medium.

The ink jet printing apparatus according to the invention is characterized by a selector mechanism for selecting the distance between the print head and the recording medium and by the plurality of the cleaning members with different lengths and different thicknesses according to the distance between the print head and the recording medium.

Further, the ink jet printing apparatus according to the invention is characterized in that an absorbent body is disposed between the cleaning members.

Further, the ink jet printing apparatus according to the invention is characterized in that the cleaning members are arranged in the direction of movement of the print head and the cleaning member to be used is selected by the carriage position according to the distance between the print head and the recording medium.

Further, the ink jet printing apparatus according to the invention is characterized in that the distance that the print head is moved by the print head position selector mechanism and the height difference between the cleaning members are set almost equal.

The ink jet printing apparatus according to the invention is characterized in that it includes: a selector mechanism for switching the position of the print head relative to the recording medium between a first print head position and a second print head position; and first and second cleaning members corresponding to the first print head position and the second print head position; wherein an engagement condition in which the first cleaning member engages the print head at the first print head position is almost identical with an engagement condition in which the second cleaning member engages the print head at the second print head position.

Further, the ink jet printing apparatus according to the invention is characterized in that the print head has an electrothermal transducer that generates thermal energy for ejecting ink.

In the ink jet printing apparatus of this invention, which comprises a print means for ejecting ink from nozzles onto a recording medium for printing, an ejection recovery means for recovering the ejection performance by engaging the print means, a selector mechanism for selecting a distance between the print head and the recording medium, and a cleaning means having a plurality of cleaning members, the cleaning members having different free end positions, lengths and/or thicknesses according to the distance between the print head and the recording medium; the cleaning method and the cleaning device of the ink jet printing apparatus using this cleaning method according to this invention are characterized in that the free ends of the plurality of cleaning members are positioned so that the forces, deflections and engagement angles of the cleaning members when they engage the print head are virtually equal among the cleaning members, that an absorbent body is arranged between the cleaning members, that the cleaning members are arranged in the direction of movement of the print head and the cleaning member to be used is selected by the carriage position according to the distance between the print head and the recording medium, and that the distance that the print head is moved by the print head position selector mechanism and the height difference between the cleaning members are set almost equal. Because of this arrangement, the print head can be wiped in good condition at all times without loading the print head and the carriage regardless of the selected print head position.

The above and other objects, effects, features and advantages of the present invention will become apparent from the following description of embodiments thereof taken in conjunction with the accompanying drawings.

BRIEF DESCRIPTION OF THE DRAWINGS

FIG. 27 is a table showing a result of experiment on a wiping performance of the conventional wiper blade for different ink adhesion states and different wiper blade contact widths;

DESCRIPTION OF THE PREFERRED EMBODIMENTS

Embodiment 1

Figure 2:
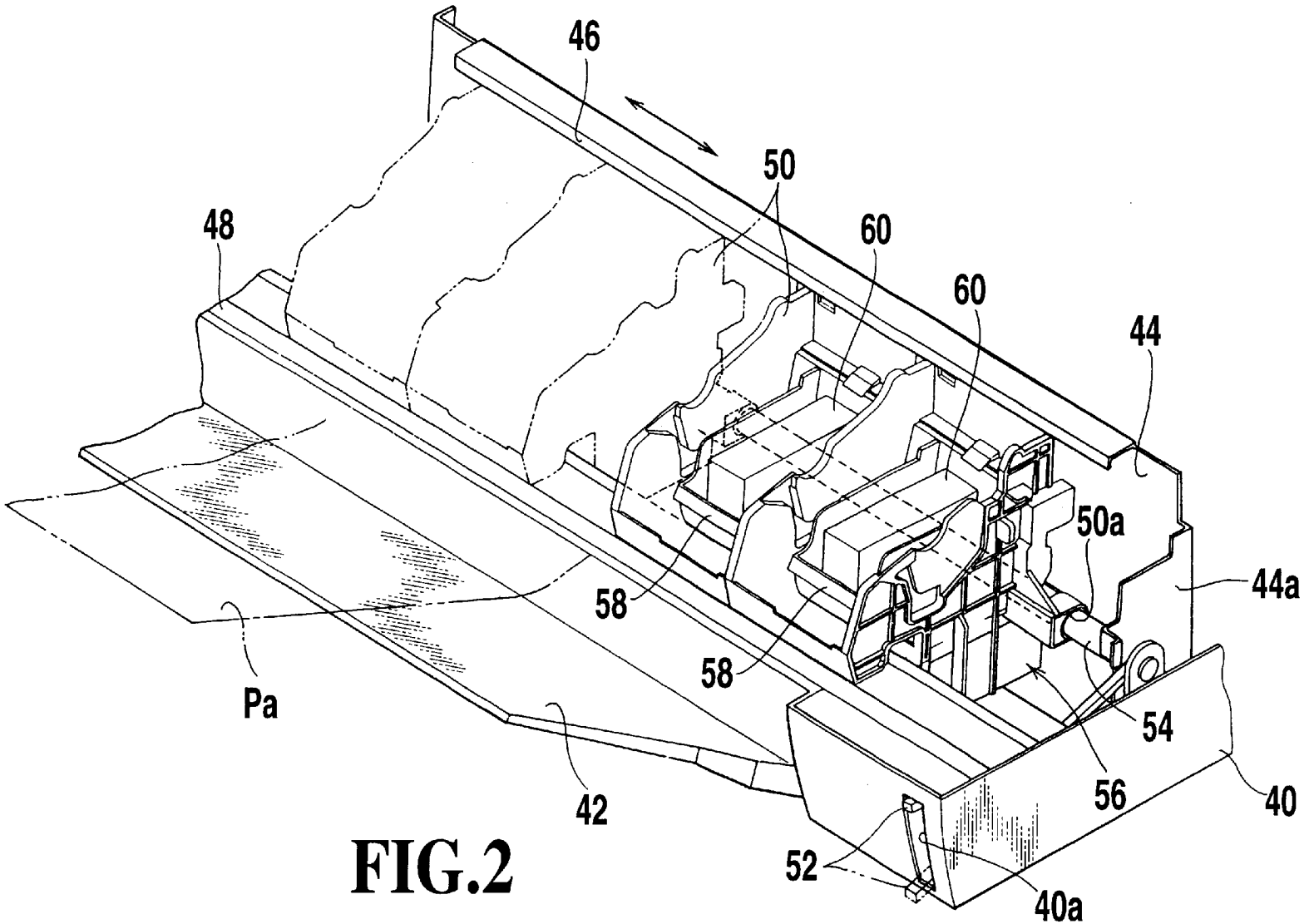
FIG. 2 is a perspective view showing an essential portion of an ink jet printing apparatus applying the first and other embodiments of the cleaning device in the ink jet printing apparatus according to the invention.

FIG. 2 shows an essential portion of an ink jet printing apparatus incorporating a first and other embodiments described later of a cleaning device in the ink jet printing apparatus according to this invention.

In FIG. 2, the apparatus includes a carriage member 50 removably carrying print heads 58 each printing on the recording surface of paper Pa as a recording medium; a discharged paper tray 42 provided on the paper discharge side of a case 40, onto which sheets of paper Pa printed by the print heads 58 are successively fed and stacked; and an ejection recovery unit 56 provided at a home position situated at the side of the paper Pa and performing ejection recovery processing on the print heads 58 to keep the ink ejection performance of the print heads 58 in a normal state.

The carriage member 50 has mounting portions for receiving the print heads 58, arranged side by side in the direction of arrow of FIG. 2, i.e., along the scan direction of the print heads 58. An upper part of the carriage member 50 is supported by an upper guide rail 46 of the chassis 44 of the case 40 disposed above and facing the carriage member 50 so that the carriage member 50 is slidable in the scan direction of the print heads 58. A front part of the carriage member 50 is supported on a front guide rail 48 of the chassis 44 so as to be slidable in the scan direction of the print heads 58. The front guide rail 48 is disposed above a base end portion of the discharged paper tray 42 and almost parallel to the upper guide rail 46. A guide shaft 54 is inserted into a through hole 50*a* formed at the base portion of the carriage member 50. The guide shaft 54 is installed below and almost parallel to the upper guide rail 46. Both ends of the guide shaft 54 are supported vertically movable by a paper distance adjust mechanism 62 provided at the sides of the chassis 44 which will be described later.

The back of the carriage member 50 is connected to a belt not shown. The belt is wound around a pair of pulleys that are arranged at a predetermined interval on that part of the chassis 44 facing the back of the carriage member 50. One of the paired pulleys is connected to an output shaft of a drive motor. The drive motor is controlled by a controller not shown. When the drive motor is operated in the forward or reverse direction, the carriage member 50 together with the print heads 58 is reciprocated back and forth, as indicated by two-dot chain lines in FIG. 2, over a distance corresponding to the recording area of the paper Pa which is fed in response to the print operation of the print heads 58. When at an appropriate timing, for example after printing, the drive motor is operated and rotated through a predetermined angle in the forward direction, the carriage member 50 together with the print heads 58 is moved to a position directly above the ejection recovery unit 56 (home position), as indicated by solid lines in FIG. 2.

The print heads 58 are of bubble jet type for example and have a known construction. Each of the print heads 58 has at its portion facing the recording surface of the paper Pa an nozzle-formed face 58*s* formed with a plurality of nozzles arranged along the direction of feed of the paper Pa.

The nozzles are open at one end of ink passages communicating with a common liquid chamber in the print head 58. Each of the ink passages has a heater as an electrothermal transducer that heats and ejects ink. The common liquid chamber in each print head 58 is connected to a corresponding ink tank 60. The ink tank 60 has a plurality of compartments formed therein by dividing its interior by partition walls. These compartments accommodate yellow, magenta, cyan and black inks and a processing liquid.

The print operation of the print head 58 is controlled by controlling the heaters according to drive control pulse signals from a print controller not shown. An ink of a desired color or a processing liquid that renders the ink insoluble is expelled in the form of droplets from respective nozzles onto the recording surface.

Figure 3:
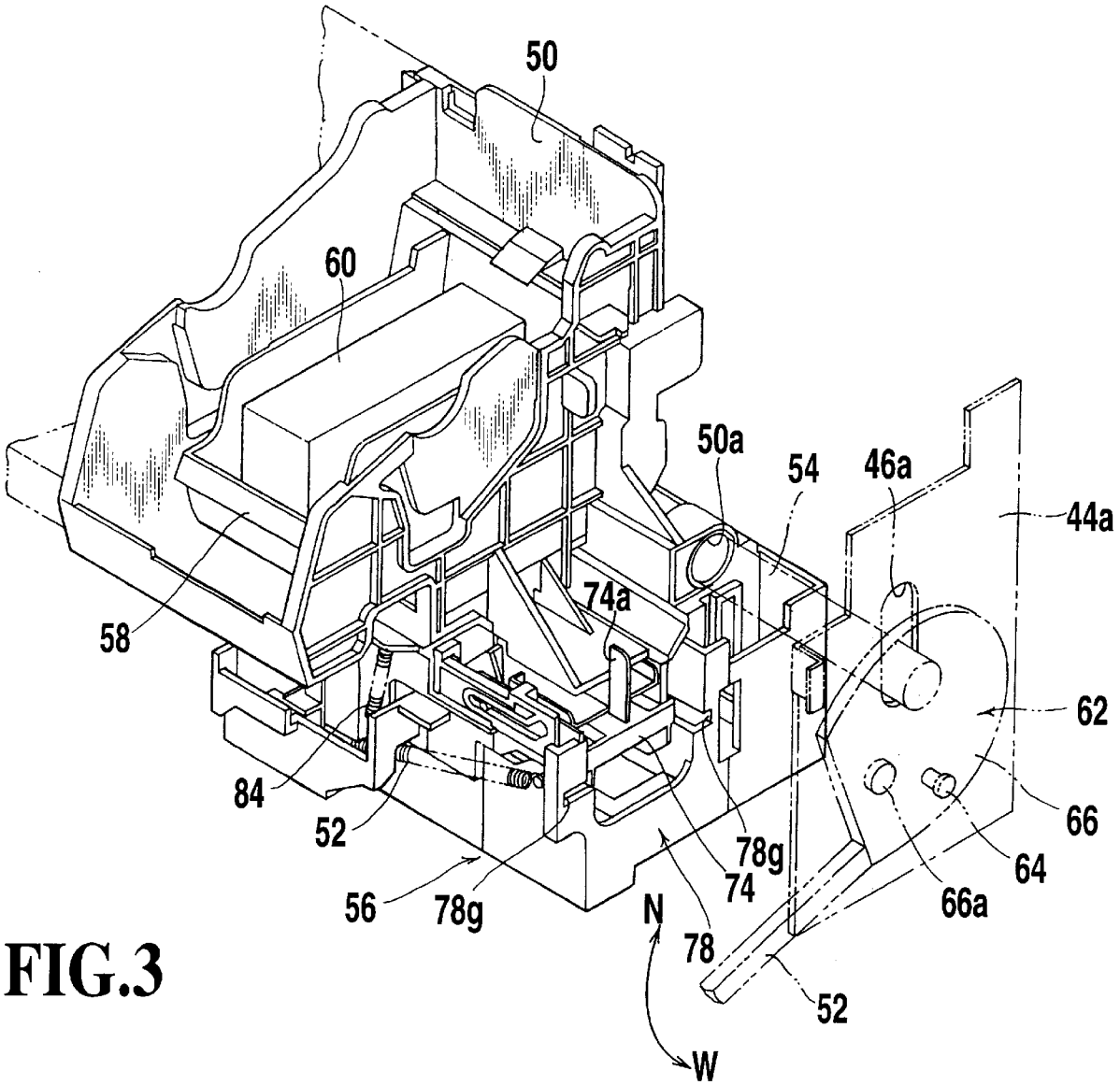
FIG. 3 is a perspective view showing an ejection recovery unit used in the embodiment of FIG. 2 along with the print head.

The paper distance adjust mechanism 62 makes adjustment in two steps and includes as major constitutional elements eccentric cam plates 66 secured to both ends of the guide shaft 54 passing through slots 46*b* of side walls 44*a* of the chassis 44; an operation lever 52 connected at one end to the eccentric cam plate 66; and a stopper member 64 for selectively holding the eccentric cam plate 66 at a predetermined angular position, as shown in FIG. 3.

Each of the eccentric cam plates 66 is pivotable about a rotary shaft 66*a* pivotally supported on the side wall 44*a*.

The end of the guide shaft 54 is secured to the inner surface of the eccentric cam plate 66 at a position spaced a predetermined distance from the rotary shaft 66*a*.

The side wall 44*a* is provided with a stopper member 64 whose outer end is selectively engaged in a recess formed at a predetermined position in the inner surface of the eccentric cam plate 66.

One of the paired eccentric cam plates 66 is connected with one end of an operation lever 52. The other end of the operation lever 52 projects outwardly through a slot 40*a* formed vertically elongate in the front surface of the case 40, as shown in FIG. 2.

When the operation lever 52 is operated in the direction of arrow W in FIG. 3, the eccentric cam plate 66 is pivoted counterclockwise, causing the outer end of the stopper member 64 to engage with the eccentric cam plate 66. Hence, the guide shaft 54 is lifted from its initial position along the slot 46*b* and held at the lifted position, so that the distance between the nozzle-formed face of the print head 58 and the paper Pa is increased by about 0.5 mm for example.

When on the other hand the guide shaft 54 is at the highest position and the operation lever 52 is operated in the direction of arrow N in FIG. 3, the eccentric cam plate 66 is pivoted clockwise, disengaging the outer end of the stopper member 64 from the eccentric cam plate 66. Hence, the guide shaft 54 is guided down along the slot 46*b* and returned to the initial position, with the result that the distance between the nozzle-formed face 58*s* of the print head 58 and the paper Pa returns to the initial value.

By operating the operation lever 52 in this way, the distance is adjusted to an appropriate value according to the thickness of the paper Pa.

Figure 4:
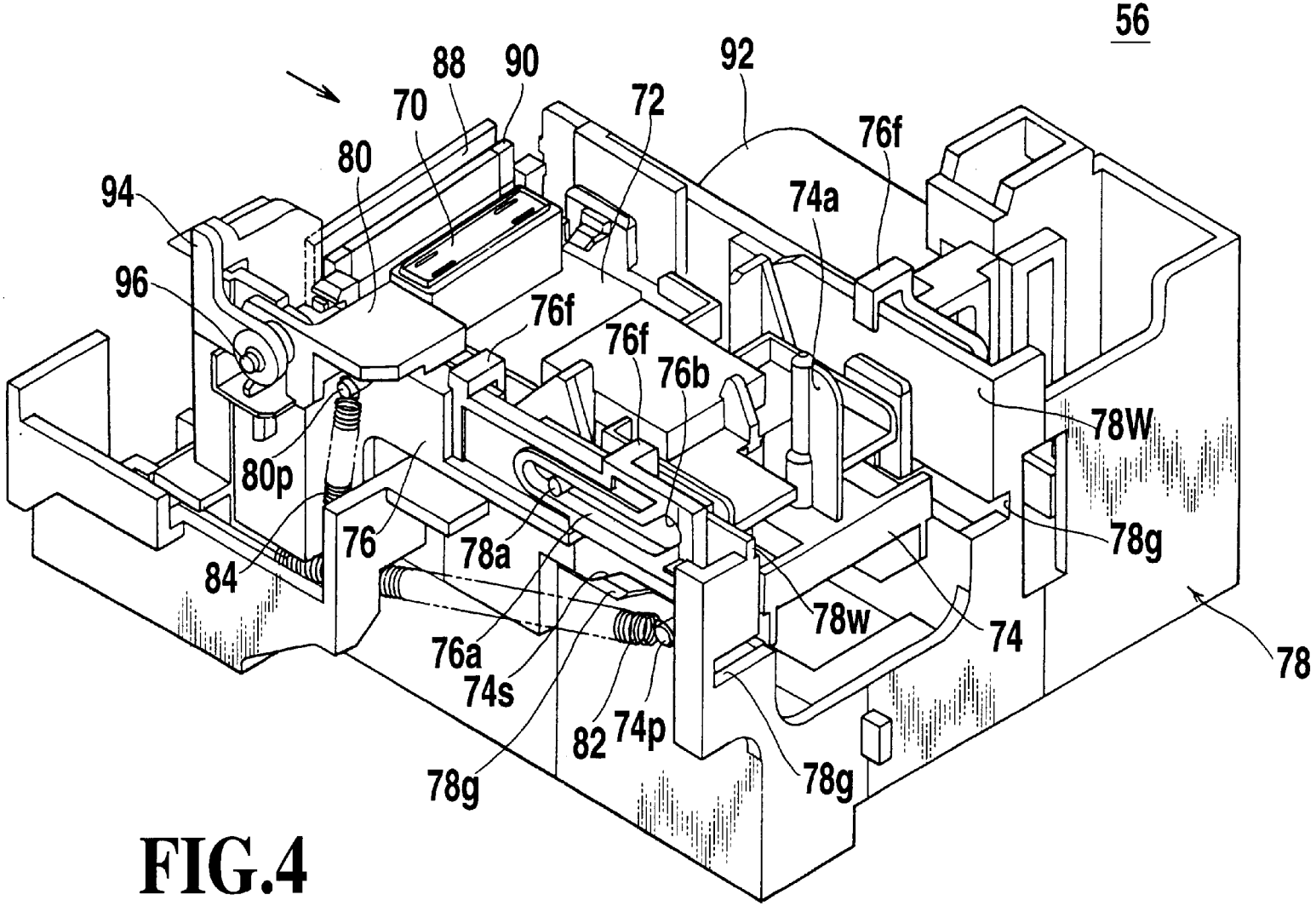
FIG. 4 is an enlarged perspective view showing the ejection recovery unit used in the embodiment of FIG. 3.

The ejection recovery unit 56, as shown in FIGS. 3 and 4, is arranged at a home position in the case 40 and includes: a case body 78 forming a housing of the ejection recovery unit 56; a slider 74 slidably supported on guide walls 78*w* formed inside the case body 78 and holding a cap holder 72 described later; a holder base 76 having wiper blades 88, 90 as cleaning members and vertically moving the wiper blades 88, 90 following the vertical motion of the slider 74; and a suction pump 92 connected to a cap member 70 held in the cap holder 72 and performing a suction operation.

The case body 78 has a pair of guide walls 78*w* that slidably guide the slider 74 to a position below the nozzle-formed face 58*s* when the print head 58 is moved to the home position. Each of the guide walls 78*w* is formed to extend along the scan direction of the print head 58. The opposing end faces of the guide walls 78*w* are each formed with a guide groove 78*g* that supports and guides the side portion of the slider 74. The guide groove 78*g* has parallel grooves at different heights. These grooves are connected together with an inclined surface that is inclined at a predetermined gradient so that the slider 74 comes near the print head 58 as it moves in the direction of arrow of FIG. 4.

The slider 74 has an engagement pin 74*a* that selectively engages the lower part of the carriage member 50, as shown in FIG. 3. The slider 74 has a connector pin 74*p* engaged by one end of a return spring 82. The other end of the return spring 82 is fixedly connected to the case body 78. Hence, when the carriage member 50 is moved in a direction opposite the arrow direction of FIG. 4 disengaging the engagement pin 74*a* from the lower part of the carriage member 50, the slider 74 is pulled back to the initial position by the force of the return spring 82.

The slider 74 has a cap holder 72 secured to the upper surface thereof, which holds the upwardly opening cap member 70. The cap member 70 selectively and hermetically contacts the nozzle-formed face 58*s* of the print head 58 as the slider 74 moves up. The cap member 70 is connected with one end of a suction tube and with one end of an open air tube. The other end of the suction tube is connected to the suction pump 92. Thus, when the cap member 70 is brought into hermetic contact with the nozzle-formed face 58*s* of the print head 58 by the upward motion of the slider 74, the nozzle-formed face 58*s* is applied a suction by operating the suction pump 92.

On the outer circumferential surfaces of guide walls 78*w* a holder base 76 with a blade holder 100 is arranged to clamp the guide walls 78*w* from outside, as shown in FIG. 4. The holder base 76 connected to the slider 74 through a connector not shown has a pair of opposing arms 76A and a connector 76B that connects the arms 76A together, as shown in FIG. 5.

Figure 5:
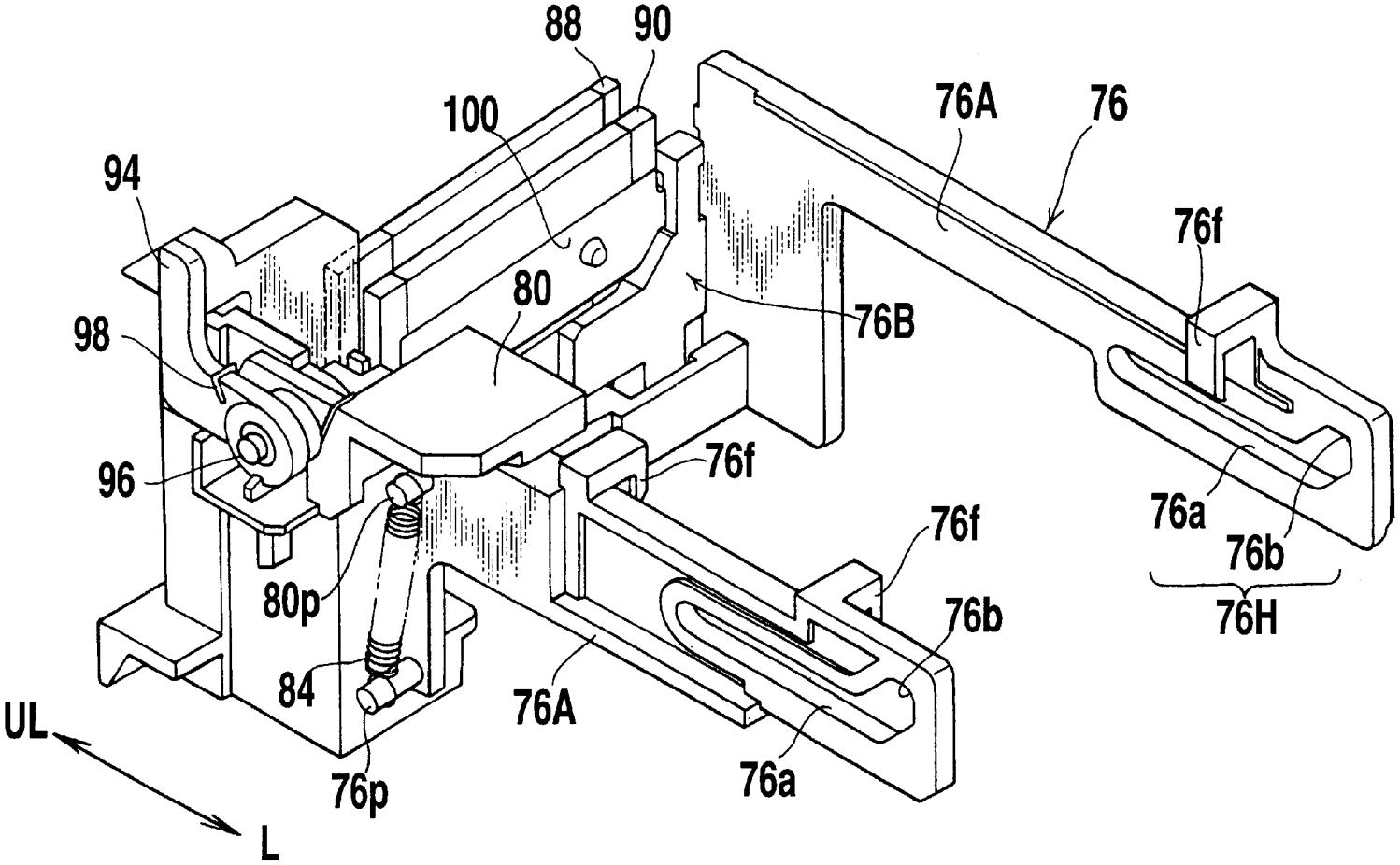
FIG. 5 is a perspective view showing a holder base used in the embodiment of FIG. 4.

Each of the arms 76A has a hook 76*f* that can engage the guide wall 78*w* of the case body 78 so that it can be moved in the direction of arrow UL or L in FIG. 5.

Each of the arms 76A also has a guide hole 76H in which a guide pin 78*a* provided on the guide wall 78*w* of the case body 78 engages. Each guide hole 76H comprises a horizontal hole 76*a* extending along the arm 76A and a vertical hole 76*b* inclined and connected to the horizontal hole 76*a*.

In this construction, when the lower part of the carriage member 50 engages the engagement pin 74*a* of the slider 74 and is moved in the direction of an arrow in FIG. 4, the slider 74 is also moved in the same direction, guided by the guide groove 78*g* and gradually lifted. During this process, the holder base 76, as it follows the slider 74 and the guide pin 78*a* slides from the vertical hole 76*b* to the horizontal hole 76*a*, gradually moves up.

At the base end portion of one arm 76A is provided a lock plate 80 that selectively engages an engagement portion provided on the case body 78. The lock plate 80 is pivotally supported by a support shaft 96 provided to the arm 76A. The lock plate 80 is urged in a direction opposite the direction of arrow UL of FIG. 5 by a coil spring 84 connected at one end to a connector pin 80*p* of the lock plate 80. The support shaft 96 supports a lever member 94 as well as the lock plate 80. The lever member 94 is connected to the lock plate 80 by a spring member 98. When the carriage member 50 is moved in the direction of arrow of FIG. 4, the lever member 94 is pivoted temporarily in the direction of arrow UL by the lower part of the carriage member 50 and then is pivoted in a direction opposite the direction of arrow UL by the force of the coil spring 84.

When the lever member 94 is pivoted in the direction of arrow UL in FIG. 5, the lock plate 80 is unlocked. When on the, other hand the lever member 94 is pivoted in a direction opposite the direction of arrow UL in FIG. 5, the lock plate 80 is locked.

Hence, when the lock plate 80 is locked, the holder base 76 is held at a predetermined position with respect to the case body 78, i.e., at the uppermost position. FIGS. 3 and 4 illustrate the state in which the slider 74 and the holder base 76 are held at the raised positions.

Figure 1:
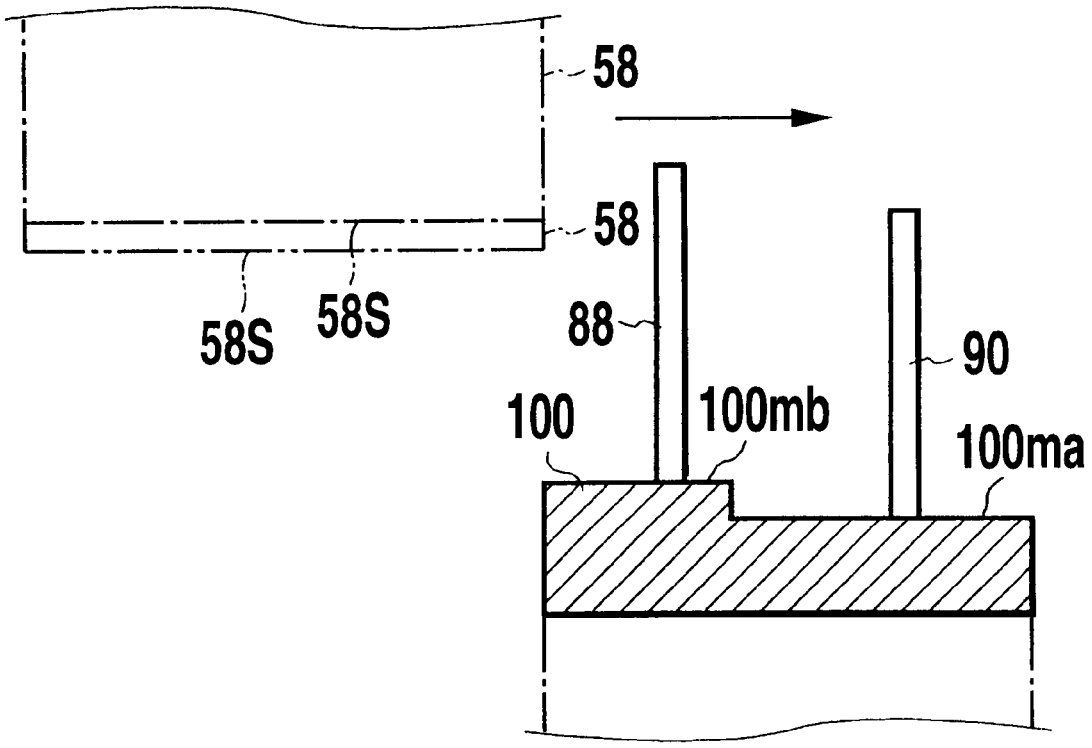
FIG. 1 is a schematic diagram showing the arrangement of wiper blades in connection with a print head, the wiper blades being provided in a first embodiment of a cleaning device in an ink jet printing apparatus according to the present invention.

The connector 76B is provided with the blade holder 100, which, as shown in FIG. 1, has flat mounting surfaces 100*ma* and 100*mb* connected together with a predetermined height difference between them. The mounting surface 100*mb* is formed closer to the recording area and at a higher position than the mounting surface 100*ma*. The height difference is set at about 0.5 mm for example.

Secured to the mounting surface 100*ma* is the lower end of a wiper blade 90 as a cleaning member which has a thickness of about 0.7 mm, a predetermined width and a total length of about 11 mm. Secured to the mounting surface 100*mb* and spaced a predetermined distance from the wiper blade 90 is the lower end of a wiper blade 88 as a cleaning member which has the similar thickness and width to those of the wiper blade 90 and a total length of about 10 mm. The wiper blades 88, 90 are made of an elastic material, such as rubber material, and have the same hardness.

When the holder base 76 is at the uppermost position, the wiper blades 88, 90 clean the nozzle-formed face 58*s* of the print head 58 as the print head is moved in the direction of arrow in FIG. 1.

The contact widths over which the wipe portions of the wiper blades 88 and 90 contact the nozzle-formed face 58*s* are set to about 0.7 mm and 1.2 mm, respectively, when the distance between the nozzle-formed face 58*s* and the paper Pa is relatively narrow and the holder base 76 is at the uppermost position. These values include a tolerance of ±0.3 mm.

Therefore, when the paper distance adjust mechanism 62 raises the nozzle-formed face 58*s* to the position indicated by the one-dot chain line in FIG. 1 to increase the distance between the nozzle-formed face 58*s* of the print head 58 and the recording surface of the paper Pa by about 0.5 mm as described above, the contact widths of the wipe portions of the wiper blades 88 and 90 are about 0.2 mm and 0.7 mm, respectively.

As a result, at least one of the contact widths of the wipe portions of the wiper blades 88 and 90 remains an appropriate value at all times even when the paper distance adjust mechanism 62 changes the distance between the nozzle-formed face 58*s* of the print head 58 and the recording surface of the paper Pa.

In the case where the wiper blades 88, 90 have the same shapes and dimensions, for example, about 0.7 mm in thickness, a predetermined dimension in width and about 10 mm in overall length, the contact widths over which the wipe-portions of the wiper blades 88, 90 contact the nozzle-formed face 58*s* may be set to about 1.2 mm and 0.7 mm, respectively, when the distance between the nozzle-formed face 58*s* and the recording surface of the paper Pa is relatively narrow and the holder base 76 is at the uppermost position. These values, too, include a tolerance of ±0.3 mm.

Where these dimensions are adopted, when the distance between the nozzle-formed face 58*s* and the recording surface of paper Pa is increased by about 0.5 mm as described above, the contact widths of the wipe portions of the wiper blades 88, 90 will be about 0.7 mm and 0.2 mm respectively. Hence, in this case, too, at least one of the contact widths of the wipe portions of the wiper blades 88, 90 is an appropriate value.

Embodiment 2

In the above embodiment the wiper blades 88, 90 are formed to have the same thicknesses and longitudinal lengths and made of the materials with the same hardness. In a second embodiment of the cleaning device of the ink jet printing apparatus according to the invention, the wiper blades BF1 and BR1 made of materials with the same hardness and formed to have different longitudinal lengths and thicknesses are mounted at their lower ends to the mounting surfaces 100*mb* and 100*ma,* respectively, of the blade holder 100 shown in FIG. 1.

When the holder base 76 is at the uppermost position, the wiper blades BF1 and BR1, as in the example described above, clean the nozzle-formed face 58*s* of the print head 58 as the print head is moved in the direction of arrow of FIG. 1.

The longitudinal length of the wiper blade BF1 is set to about 10.0 mm and that of the wiper blade BR1 to about 10.8 mm.

The thickness of the wiper blade BF1 is set to about 0.7 mm and that of the wiper blade BR1 to about 0.9 mm.

The contact widths over which the wipe portions of the wiper blades BF1 and BR1 contact the nozzle-formed face 58*s* are set to about 0.7 mm and 1.2 mm, respectively, when the distance between the nozzle-formed face 58*s* of the print head 58 and the recording surface of the paper Pa is relatively narrow and the holder base 76 is at the uppermost position. These values include a tolerance of ±0.3 mm.

The pressures with which the wipe portions of the wiper blades BF1 and BR1 engage the nozzle-formed face 58*s* are set, for example, to about 20 g/cm$^2$ and 22 g/cm$^2$ respectively. The angles at which the wipe portions of the wiper blades BF1 and BR1 engage are set, for example, to about 45 and 42 degrees, respectively.

The angles of engagement are the angles formed by tangents drawn to the end faces of the wiper blades BF1 and BR1 on the side of the print head 58 and the nozzle-formed face 58*s* of the print head 58.

The lengths, in the thickness direction or in the direction of movement of the print head 58, of the contact areas between the wipe portions of the wiper blades BF1 and BR1 and the nozzle-formed face 58*s* (nip widths) are set, for example, to about 100 $\mu$m and 140 $\mu$m, respectively.

When the paper distance adjust mechanism 62 raises the nozzle-formed face 58*s* to the position indicated by the one-dot chain line of FIG. 1 to increase the distance between the nozzle-formed face 58*s* of the print head 58 and the recording surface of the paper Pa by about 0.5 mm as described above, the contact widths of the wipe portions of the wiper blades BF1 and BR1 will be about 0.2 mm and 0.7 mm, respectively.

Further, according to the experiments conducted by the inventor of this invention, when the distance to paper is increased, the engagement pressure at which the wipe portions of the wiper blades BF1 and BR1 engage the nozzle-formed face 58*s* are set, for example, to about 20 g/cm$^2$ and 21 g/cm$^2$, respectively, and the engagement angles of the wipe portions of the wiper blades BF1 and BR1 are set, for example, to about 45 and 44 degrees, respectively. Further, the lengths, in the thickness direction or in the direction of movement of the print head 58, of the contact areas between the wipe portions of the wiper blades BF1 and BR1 and the nozzle-formed face 58*s* (nip widths) are set, for example, to about 100 $\mu$m and 110 $\mu$m, respectively.

Therefore, even when the distance between the nozzle-formed face 58*s* of the print head 58 and the recording surface of the paper Pa is changed by a predetermined amount, none of the engagement pressures, engagement angles and nip widths of the wipe portions of the wiper blades BF1 and BR1 with respect to the nozzle-formed face 58*s* exhibits any significant changes, thus assuring a stable wiping.

Embodiment 3

In the first embodiment the wiper blades 88 and 90 are formed to have the same thicknesses and longitudinal lengths and made of materials with the same hardness. In the third embodiment of the cleaning device of the ink jet printing apparatus according to the invention, the wiper blades BF2 and BR2 made of materials with the same hardness and formed to have different longitudinal lengths and thicknesses are mounted at their lower ends to the mounting surfaces 100*mb* and 100*ma,* respectively, of the blade holder 100 shown in FIG. 1.

When the holder base 76 is at the uppermost position, the wiper blades BF2 and BR2 clean the nozzle-formed face 58*s* of the print head 58 as the print head is moved in the direction of arrow of FIG. 1. The wiper blade BF2 is designed mainly to wipe off an adhering pigment ink and the wiper blade BR2 an adhering dye ink.

In this example, the print head 58 ejects a pigment ink of a particular color when the distance between the nozzle-formed face 58*s* of the print head 58 and the recording surface of the paper Pa is relatively narrow. When the distance between the nozzle-formed face 58*s* and the recording surface is relatively wide, the print head is replaced to eject a dye ink of a particular color.

The longitudinal length of the wiper blade BF2 is set to about 6.0 mm and that of the wiper blade BR2 to about 12 mm.

The thickness of the wiper blade BF2 is set to about 0.9 mm and that of the wiper blade BR2 to about 0.7 mm.

The contact widths over which the wipe portions of the wiper blades BF2 and BR2 contact the nozzle-formed face 58*s* are set to about 0.5 mm and 1.5 mm, respectively, when the distance between the nozzle-formed face 58*s* of the print head 58 and the recording surface of the paper Pa is relatively narrow and the holder base 76 is at the uppermost position. These values include a tolerance of ±0.3 mm.

The pressures with which the wipe portions of the wiper blades BF2 and BR2 engage the nozzle-formed face 58*s* are set, for example, to about 30 g/cm$^2$ and 20 g/cm$^2$ respectively. The angles at which the wipe portions of the wiper blades BF2 and BR2 engage are set, for example, to about 40 and 50 degrees, respectively. The engagement angles are included angles similar to those of the preceding embodiment.

The lengths, in the thickness direction or in the direction of movement of the print head 58, of the contact areas between the wipe portions of the wiper blades BF2 and BR2 and the nozzle-formed face 58*s* (nip widths) are set, for example, to about 80 $\mu$m and 150 $\mu$m, respectively. As a result, the surface pressure of the wipe portion of the wiper blade BF2 is higher than that of the wiper blade BR2, so that most part of the adhering pigment ink is easily wiped off by the wipe portion of the wiper blade BF2.

When the paper distance adjust mechanism 62 raises the nozzle-formed face 58*s* of the print head 58 to the position indicated by the one-dot chain line of FIG. 1 to increase the distance between the nozzle-formed face 58*s* of the print head 58 and the recording surface of the paper Pa by about 0.5 mm as described above, the contact widths of the wipe portions of the wiper blades BF2 and BR2 will be about 0.0 mm and 1.0 mm, respectively.

It has been verified by the inventor of this invention that the pigment ink adhering to the nozzle-formed face 58*s* of the print head 58 can be efficiently wiped away and that, even when the distance between the nozzle-formed face 58*s* of the print head 58 and the recording surface of the paper Pa is changed by a predetermined amount, none of the engagement pressure, engagement angle and nip width of the wipe portion of the wiper blade BR2 with respect to the nozzle-formed face 58*s* exhibits any significant changes, thus assuring a stable wiping.

Although in the above examples the wiping conditions such as the engagement pressure, engagement angle and nip width are changed according to whether the ink used is a pigment ink or dye ink, the wiping conditions may also be changed appropriately according to the compositions of individual inks.

Embodiment 4

In the first embodiment the wiper blades 88 and 90 are formed to have the same thicknesses and longitudinal lengths and made of materials with the same hardness. In the fourth embodiment of the cleaning device of the ink jet printing apparatus according to the invention, the wiper blades BF3 and BR3 made of materials with the same hardness and formed to have different longitudinal lengths are mounted at their lower ends to the mounting surfaces 100*mb* and 100*ma,* respectively, of the blade holder 100 shown in FIG. 1.

When the holder base 76 is at the uppermost position, the wiper blades BF3 and BR3 clean the nozzle-formed face 58*s* of the print head 58 as the print head is moved in the direction of arrow of FIG. 1. The wiper blade BF3 is designed mainly to wipe off an ink adhering to the nozzle-formed face of a monochromatic print head, while the wiper blade BR3 is designed mainly to wipe off an ink adhering to the nozzle-formed face of a color image print head.

In this example, when the print head 58 is a color image print head that ejects a predetermined number of color inks, the distance between the nozzle-formed face 58*s* of the print head 58 and the recording surface of the paper Pa is set relatively narrow. When the print head 58 is a monochromatic print head that ejects a dye ink of a particular color, the distance between the nozzle-formed face 58*s* and the recording surface is set relatively wide.

The longitudinal length of the wiper blade BF3 is set to about 10.0 mm and that of the wiper blade BR3 to about 12 mm.

The thicknesses of the wiper blades BF3 and BR3 are set to about 0.9 mm.

The contact widths over which the wipe portions of the wiper blades BF3 and BR3 contact the nozzle-formed face 58*s* are set to about 0.8 mm and 1.4 mm, respectively, when the distance between the nozzle-formed face 58*s* of the print head 58 and the recording surface of the paper Pa is relatively narrow and the holder base 76 is at the uppermost position. These values include a tolerance of ±0.3 mm.

The pressures with which the wipe portions of the wiper blades BF3 and BR3 engage the nozzle-formed face 58*s* are set, for example, to about 25 g/cm$^2$ and 20 g/cm$^2$ respectively. The angles at which the wipe portions of the wiper blades BF3 and BR3 engage are set, for example, to about 42 and 45 degrees, respectively. The engagement angles are included angles similar to those of the preceding embodiment.

The lengths, in the thickness direction or in the direction of movement of the print head 58, of the contact areas between the wipe portions of the wiper blades BF3 and BR3 and the nozzle-formed face 58*s* (nip widths) are set, for example, to about 100 $\mu$m and 150 $\mu$m, respectively. As a result, the surface pressure of the wipe portion of the wiper blade BF3 is higher than that of the wiper blade BR3, so that most part of the ink adhering to the nozzle-formed face of the monochromatic print head 58 is easily wiped off by the wipe portion of the wiper blade BF3. That is, even in the monochromatic print head which has a relatively small amount of adhering ink and is difficult to wipe clean when compared to the color image print head, the adhering ink can easily be wiped off.

When the paper distance adjust mechanism 62 raises the nozzle-formed face 58*s* of the print head 58 to the position indicated by the one-dot chain line of FIG. 1 to increase the distance between the nozzle-formed face 58*s* of the print head 58 and the recording surface of the paper Pa by about 0.5 mm as described above, the contact widths of the wipe portions of the wiper blades BF3 and BR3 will be about 0.3 mm and 0.9 mm, respectively.

It has been verified by the inventor of this invention that, even when the distance between the nozzle-formed face of the monochromatic print head 58 and the recording surface of the paper Pa is relatively wide, none of the engagement pressure, engagement angle and nip width of the wipe portion of the wiper blade BR3 with respect to the nozzle-formed face 58*s* exhibits any significant changes, thus assuring a stable wiping.

Embodiment 5

In the first embodiment the wiper blades 88 and 90 are formed to have the same thicknesses and longitudinal lengths widths and made of materials with the same hardness. In the fifth embodiment of the cleaning device of the ink jet printing apparatus according to the invention, the wiper blades BF4 and BR4 made of materials with different hardnesses and formed to have different longitudinal lengths are mounted at their lower ends to the mounting surfaces 100*mb* and 100*ma,* respectively, of the blade holder 100 shown in FIG. 1. When the holder base 76 is at the uppermost position, the wiper blades BF4 and BR4 clean the nozzle-formed face 58*s* of the print head 58 as the print head is moved in the direction of arrow of FIG. 1.

The wiper blade BF4 is made of an elastic material such as rubber material (HNBR) with hardness of 50 (Asca C). The wiper blade BR4 is made of an elastic material such as rubber material (HNBR) with hardness of 70 (Asca C)70.

The contact widths over which the wipe portions of the wiper blades BF4 and BR4 contact the nozzle-formed face 58*s* are set to about 1.2 mm and 0.7 mm, respectively, when the distance between the nozzle-formed face 58*s* of the print head 58 and the recording surface of the paper Pa is relatively narrow and the holder base 76 is at the uppermost position. These values include a tolerance of ±0.3 mm.

When the paper distance adjust mechanism 62 raises the nozzle-formed face 58*s* to the position indicated by the one-dot chain line of FIG. 1 to increase the distance between the nozzle-formed face of the print head 58 and the recording surface of the paper Pa by about 0.5 mm as described above, the contact widths of the wipe portions of the wiper blades BF4 and BR4 will be about 0.7 mm and 0.2 mm, respectively.

As a result, even when the distance between the nozzle-formed face 58*s* of the print head 58 and the recording surface of the paper Pa is changed by the paper distance adjust mechanism 62, at least one of the contact widths of the wipe portions of the wiper blades BF4 and BR4 can remain an appropriate value at all times. Further, because the hardness of the wiper blade BR4 is set larger than the hardness of the wiper blade BF4 by a predetermined amount, the amount of deformation of the wiper blade BR4 can be made smaller and significant changes in the engagement conditions including the engagement pressure can be suppressed.

Embodiment 6

Figure 6:
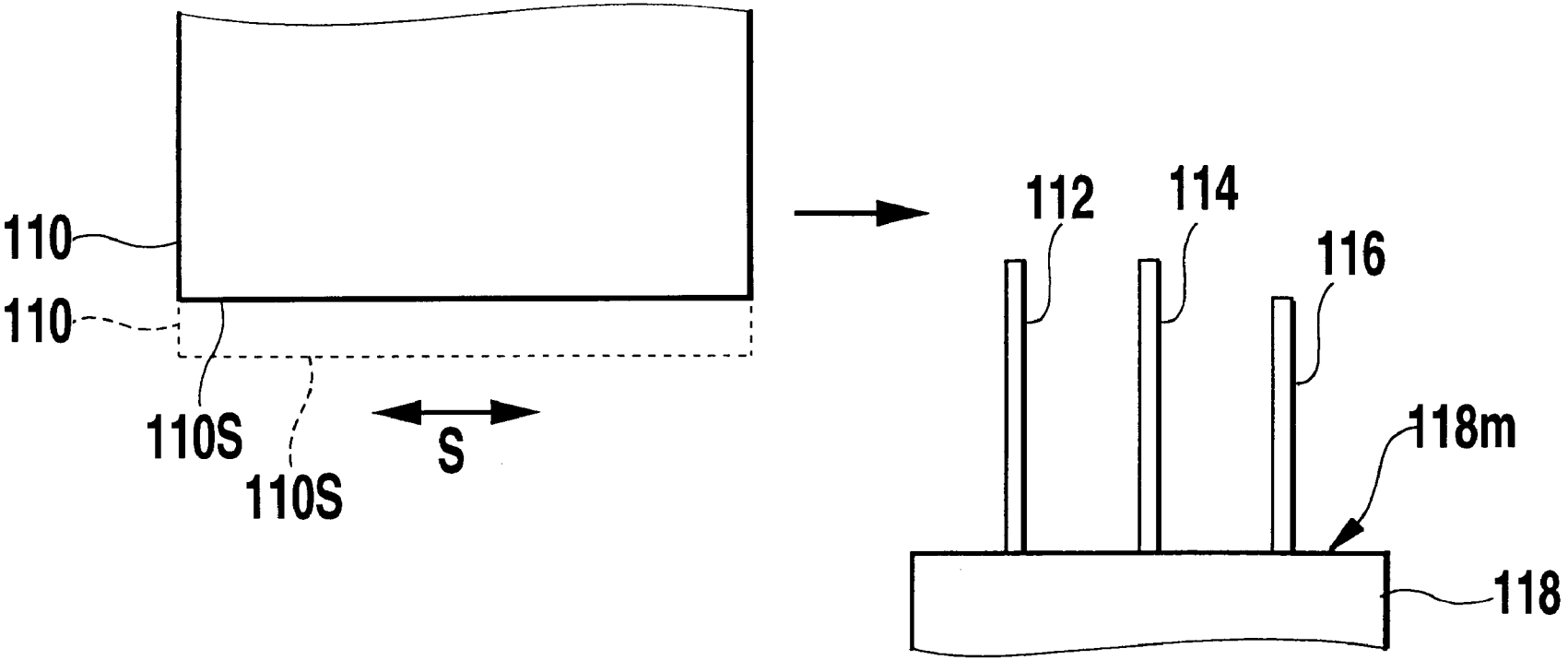
FIG. 6 is a schematic diagram showing the arrangement of wiper blades in connection with the print head, the wiper blades being provided in a sixth embodiment of the cleaning device in the ink jet printing apparatus according to the invention.

FIG. 6 shows an.essential portion of a sixth embodiment of the cleaning device in the ink jet printing apparatus according to the invention.

In FIG. 6, a print head 110 selectively mounted to or removed from the carriage member 50 is of bubble jet type for example and has a known construction. The print head 110 has at its portion facing the recording surface of the paper an nozzle-formed face 110*s* formed with a plurality of nozzles arranged along the direction of feed of the paper Pa.

The nozzle-formed face 110*s* is formed with a plurality of nozzle rows arranged in a direction almost perpendicular to the direction of paper feed. These nozzle rows include, from the side of a wiper blade 112 described later, a nozzle row 110Y for ejecting a yellow ink, a nozzle row 110M for ejecting a magenta ink, a nozzle row 110C for ejecting a cyan ink, a nozzle row 110LM for ejecting a light magenta ink, a nozzle row LC for ejecting a light cyan ink, and a nozzle row 110BK for ejecting a black ink.

The individual nozzles of each nozzle row are open at one end of ink passages communicating with a common liquid chamber in the print head 110. Each of the ink passages has a heater, as an electrothermal transducer that heats and ejects ink. The common liquid chamber in each print head 110 is connected to a corresponding ink tank. The ink tank has a plurality of compartments formed therein by dividing its interior by partition walls. These compartments accommodate, for example, color inks described above.

The print head 110 mounted on carriage member 50 is reciprocated back and forth in the direction of arrow S of FIG. 6 over a predetermined distance corresponding to the recording area of the paper which is fed in response to the print operation of the print head 110. When at an appropriate timing, for example after printing, the drive motor is operated and rotated through a predetermined angle in the forward direction, the print head 110 is moved to a position directly above the ejection recovery unit 56 (home position).

The print operation of the print head 110 is controlled by controlling the heaters according to drive control pulse signals from a print controller not shown. An ink of a desired color is expelled in the form of droplets from respective nozzles onto the recording surface of paper.

The connector 76B in FIG. 5 is provided with a blade holder 118 of FIG. 6. The blade holder 118 has a flat mounting surface 118*m*.

Secured to the mounting surface 118*m* at a position closest to the print head 110 nearing the home position is, for example, the lower end of a wiper blade 112 which has a thickness of about 0.65 mm, a width of about 23.0 mm and a total length of about 5.3 mm. The width of the wiper blade 112 is set larger than the dimension of a hermetic contact area CR measured in the arrangement direction of nozzles so that the wiper blade 112 can wipe the entire hermetic contact area CR of the capping member in the ejection recovery device that sucks all the nozzle rows of FIG. 7 at one time. The wiper blade 112 is made of an elastic material such as rubber material (HNBR: G655, hardness 75, Asca C scale).

On the mounting surface 118*m* a wiper blade 114 is provided adjacent to and parallel to the wiper blade 112 with a predetermined interval therebetween. The wiper blade 114 is made of a material similar to the wiper blade 112 and is about 0.65 mm thick, about 14.0 mm wide and about 5.3 mm long. The width of the wiper blade 114 measured in the arrangement direction of nozzles is set so as to be able to wipe all nozzles but smaller than the width of the wiper blade 112.

Further, on the mounting surface 118*m* a wiper blade 116 is provided adjacent to and parallel to the wiper blade 114 with a predetermined interval therebetween. It is located at a position most distant from the print head 110 approaching the home position. The wiper blade 116 is made of a material similar to the wiper blade 112 and is about 0.65 mm thick, about 14.0 mm wide and about 4.7 mm long.

When the holder base 76 is at the uppermost position, the wiper blades 112, 114 and 116 perform the wiping operation on the nozzle-formed face 110*s* of the print head 110 as the print head is moved in the direction of arrow of FIG. 6 at a predetermined speed, for example, 120 mm/s.

The contact widths over which the wipe portions of the wiper blades 112 and 114 contact the nozzle-formed face 110*s* are set to about 1.4 mm when the distance between the nozzle-formed face 110*s* of the print head 110 and the recording surface of the paper Pa is relatively narrow and the holder base 76 is at the uppermost position. The contact width over which the wipe portion of the wiper blade 116 contacts the nozzle-formed face 110*s* is set to about 0.8 mm when the distance between the nozzle-formed face 110*s* of the print head 110 and the recording surface of the paper Pa is relatively narrow and the holder base 76 is at the uppermost position.

When the paper distance adjust mechanism 62 raises the nozzle-formed face 110*s* to the position indicated by the solid line of FIG. 6 to increase the distance between the nozzle-formed face 110*s* of the print head 110 and the recording surface of the paper by about 0.5 mm as described above, the contact widths of the wipe portions of the wiper blades 112 and 114 will be about 0.9 mm and 0.3 mm, respectively.

As a result, even when the distance between the nozzle-formed face of the print head 110 and the recording surface of the paper is changed by the paper distance adjust mechanism 62, the contact widths of the wipe portions of the wiper blades 112, 114 and 116 can remain appropriate values at all times.

Embodiment 7

Figure 7:
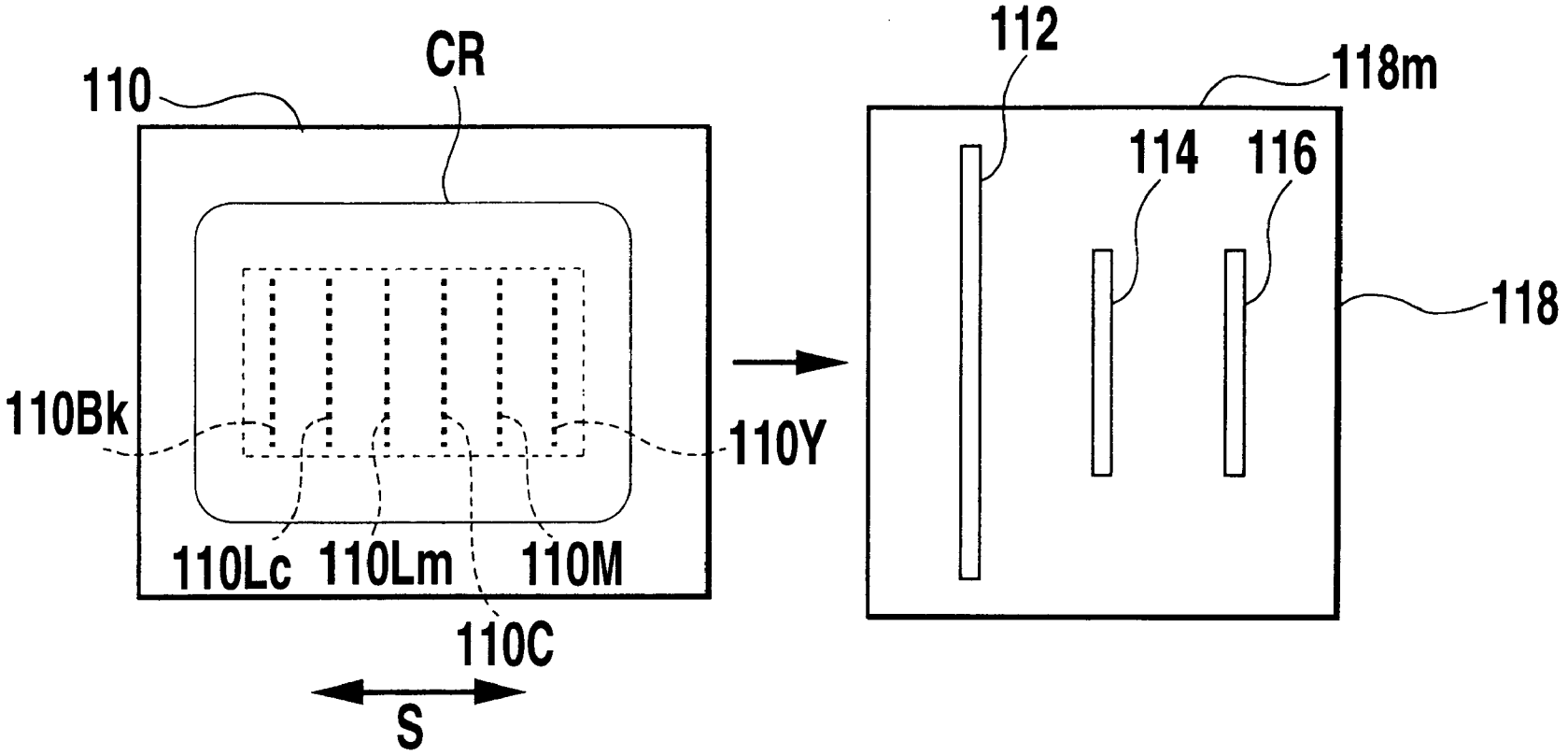
FIG. 7 is a plan view of the embodiment of FIG. 6.
Figure 8:
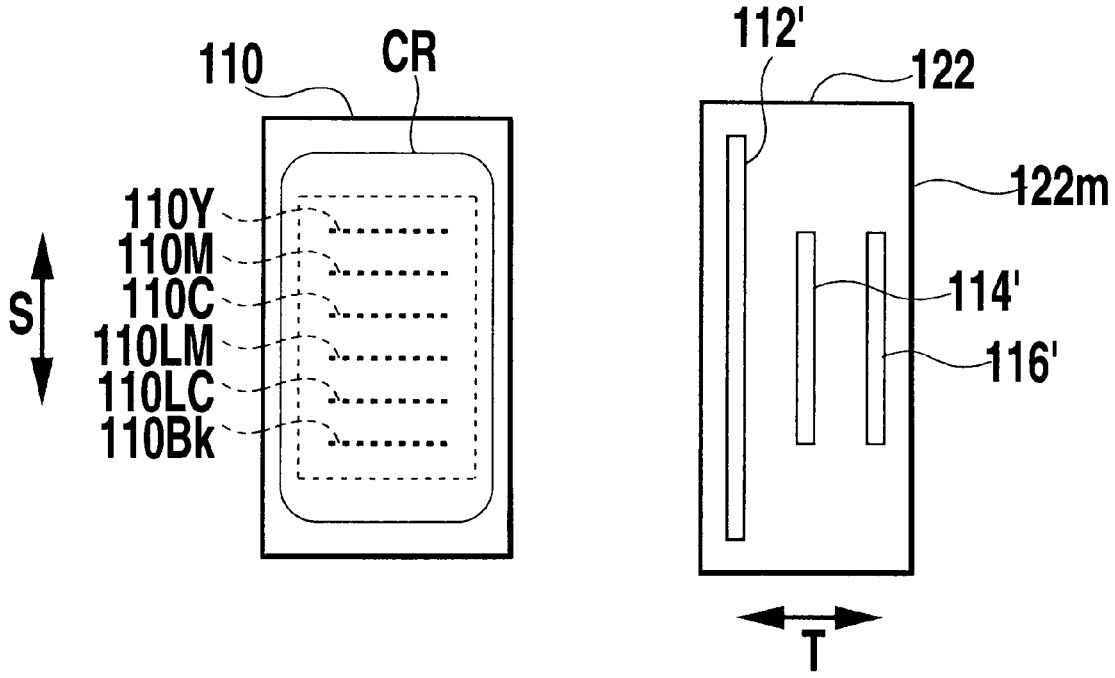
FIG. 8 is a plan view showing the arrangement of wiper blades in connection with the print head, the wiper blades being provided in a seventh embodiment of the cleaning device in the ink jet printing apparatus according to the invention.

FIG. 8 shows an essential portion of a seventh embodiment of the cleaning device in the ink jet printing apparatus according to the invention. In FIG. 8, constitutional elements identical with those shown in FIGS. 6 and 7 are assigned like reference numerals and their explanations are omitted.

In the example shown in FIGS. 6 and 7, the print head 110 is moved relative to the wiper blades 112', 114' and 116'. In FIG. 8, a blade holder 122 is moved relative to the print,head 110, which is stationary at a predetermined position, in a direction of arrow T by a moving mechanism not shown. The blade holder 122 has a flat mounting surface 122*m,* on which the wiper blades 112', 114' and 116' are arranged.

The wiper blades 112', 114', 116' are arranged parallel to each other at predetermined intervals, with the wiper blade 112' located at a position closest to the print head 110 and the wiper blade 116' at a position farthest from the print head 110. The wiper blades 112', 114', 116' are arranged so that their end faces in their thickness direction are perpendicular to the direction of nozzle rows in the print head 110.

The wiper blade 112' has a thickness of about 0.65 mm, a predetermined width and a total length of about 5.3 mm. The width of the wiper blade 112' is set larger than the dimension of a hermetic contact area CR measured in the arrangement direction of nozzle rows 110Y–110BK so that the wiper blade 112' can wipe the entire hermetic contact area CR of the capping member in the ejection recovery device that sucks all the nozzle rows of FIG. 7 at one time. The wiper blade 112' is made of an elastic material such as rubber material (HNBR: G655, hardness 75, Asca C scale). The wiper blade 114' is made of a material similar to that of the wiper blade 112' and has a thickness of about 0.65 mm, a predetermined width and a total length of about 5.3 mm. The width of the wiper blade 114' measured in the arrangement direction of the nozzle rows is set so that it can wipe all nozzles, but is smaller than the width of the wiper blade 112'. The wiper blade 116' is made of a material similar to that of the wiper blade 112' and has a thickness of about 0.65 mm, the same width as the wiper blade 114' and a total length of about 4.7 mm.

The contact widths over which the wipe portions of the wiper blades 112' and 114' contact the nozzle-formed face 110*s* are set to about 1.4 mm when the distance between the nozzle-formed face 110*s* of the print head 110 and the recording surface of the paper Pa is relatively narrow and the holder base 76 is at the uppermost position. The contact width over which the wipe portion of the wiper blade 116' contacts the nozzle-formed face 110*s* is set to about 0.8 mm when the distance between the nozzle-formed face 110*s* of the print head 110 and the recording surface of the paper Pa is relatively narrow and the holder base 76 is at the uppermost position.

When the paper distance adjust mechanism 62 raises the nozzle-formed face 110*s* to increase the distance between the nozzle-formed face of the print head 110 and the recording surface of the paper by about 0.5 mm as described above, the contact widths of the wipe portions of the wiper blades 112' and 114' will be about 0.9 mm and 0.3 mm, respectively.

As a result, in this example, too, even when the distance between the nozzle-formed face of the print head 110 and the recording surface of the paper is changed by the paper distance adjust mechanism 62, the contact widths of the, wipe portions of the wiper blades 112', 114', 116' can remain appropriate values at all times.

Embodiment 8

Figure 9:
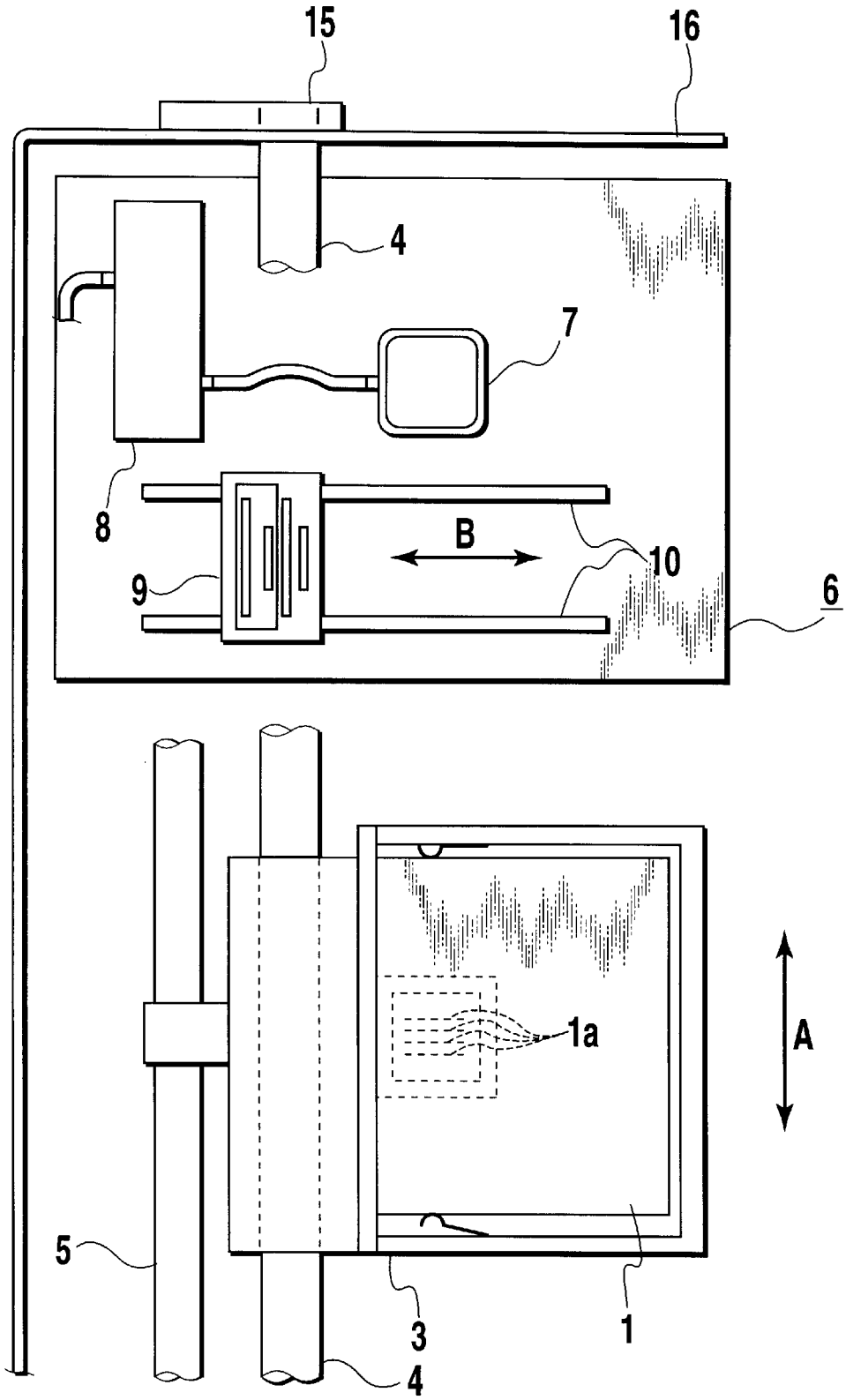
FIG. 9 is a plan view showing the overall outline construction of an eighth embodiment of the ink jet printing apparatus according to the invention.

FIG. 9 shows an overall construction of an eighth embodiment of the ink jet printing apparatus according to the invention. The print head 1 in the ink jet printing apparatus applying this invention forms an image by ejecting ink droplets of a single color or a plurality of colors from a plurality of nozzles la formed in the print head 1. The printing systems available include a bubble jet type that generates bubbles in ink by thermal energy to eject ink droplets and a piezoelectric type that ejects ink droplets by piezoelectric elements.

The print head 1 is positioned on a carriage 3, which is movably supported and guided on a carriage shaft 4. The carriage 3 is securely attached with a belt 5 which is moved in,the direction of arrow A in the Figure by a drive source not shown.

An ejection recovery unit 6 that performs a variety of ejection performance recovering operations, such as wiping, capping and sucking of the print head 1, has a cap 7 for capping the nozzle surface of the print head 1 to protect the nozzle portion and suck out ink from the nozzles 1*a;* a pump 8 communicating to the cap 7 to draw out ink by suction from the nozzles 1*a* of the print head 1; and a plurality of wiper blades 9*a*–9*d* movably supported and guided on a wiper blade guide 10 in the direction of arrow B by a drive source (not shown). The ejection recovery unit 6 also includes a preliminary ejection position, located outside the recording area, where a preliminary ejection of ink from the nozzles 1*a* of the print head 1 is performed to maintain the ejection performance of the print head 1. The wiping is done by moving the carriage 3 to a position where the nozzles 1*a* of the print head 1 face the wiper blade unit 9 and driving the wiper blade unit 9 in the direction of arrow B.

Figure 10:
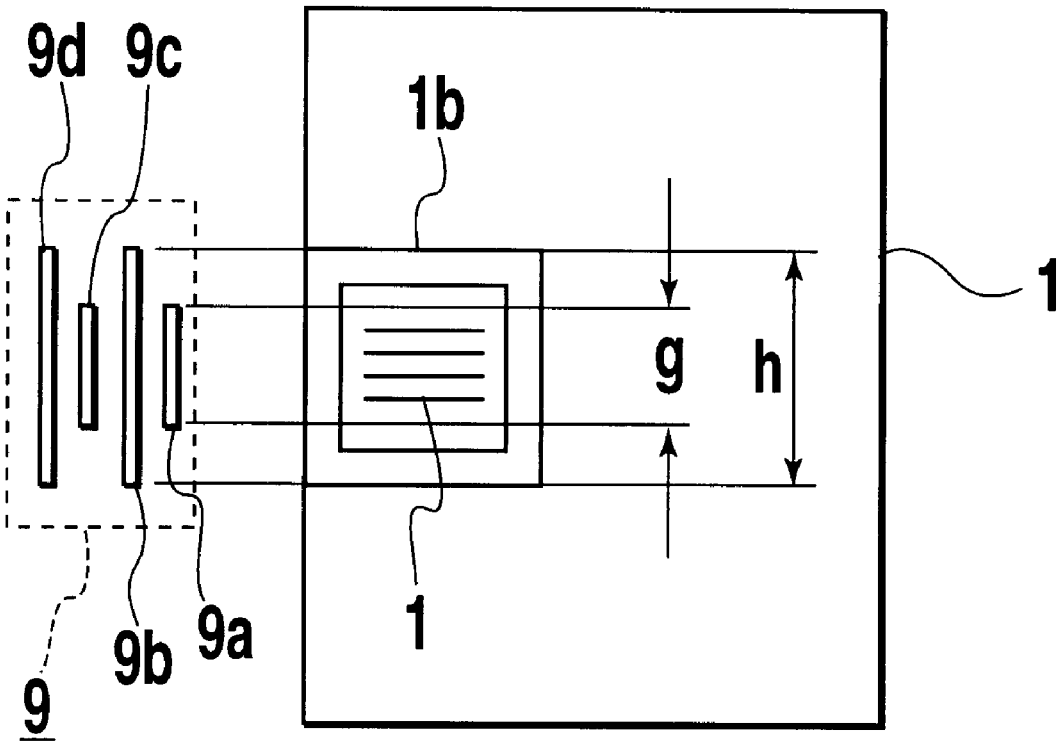
FIG. 10 is a partial plan view showing the widthwise construction of the wiper blades of the eighth embodiment of the invention shown in FIG. 9.

FIG. 10 shows the construction of the wiper blades in the direction of their width. The wiper blade unit 9 has a plurality of wiper blades 9*a, 9b, 9c, 9d*. The widths g of the wiper blades 9*a, 9c* are set to cover the nozzles 1*a* and thus these blades can clean the nozzles 1*a* well. The widths h of the wiper blades 9*b, 9d* are set to cover a face 1*b* of the print head 1 that constitutes the nozzle-formed face of the print head 1 and thus these blades can clear well the contamination produced during capping and sucking from the entire face. While this embodiment shows a construction in which the wiper blades 9*a, 9b* are arranged in this order, the construction may be changed to have these wiper blades arranged in the order of 9*b* and 9*a* for example.

Although this embodiment uses a plurality of wiper blades 9*a, 9b, 9c, 9d* for the nozzles and for the nozzle-formed face, they may be replaced with the nozzle blades or the nozzle-formed face blades for simplicity. In that case, only the wiper blades 9*b, 9d* for the nozzle-formed face can serve both functions by appropriately setting the wiper blades.

Figure 11:
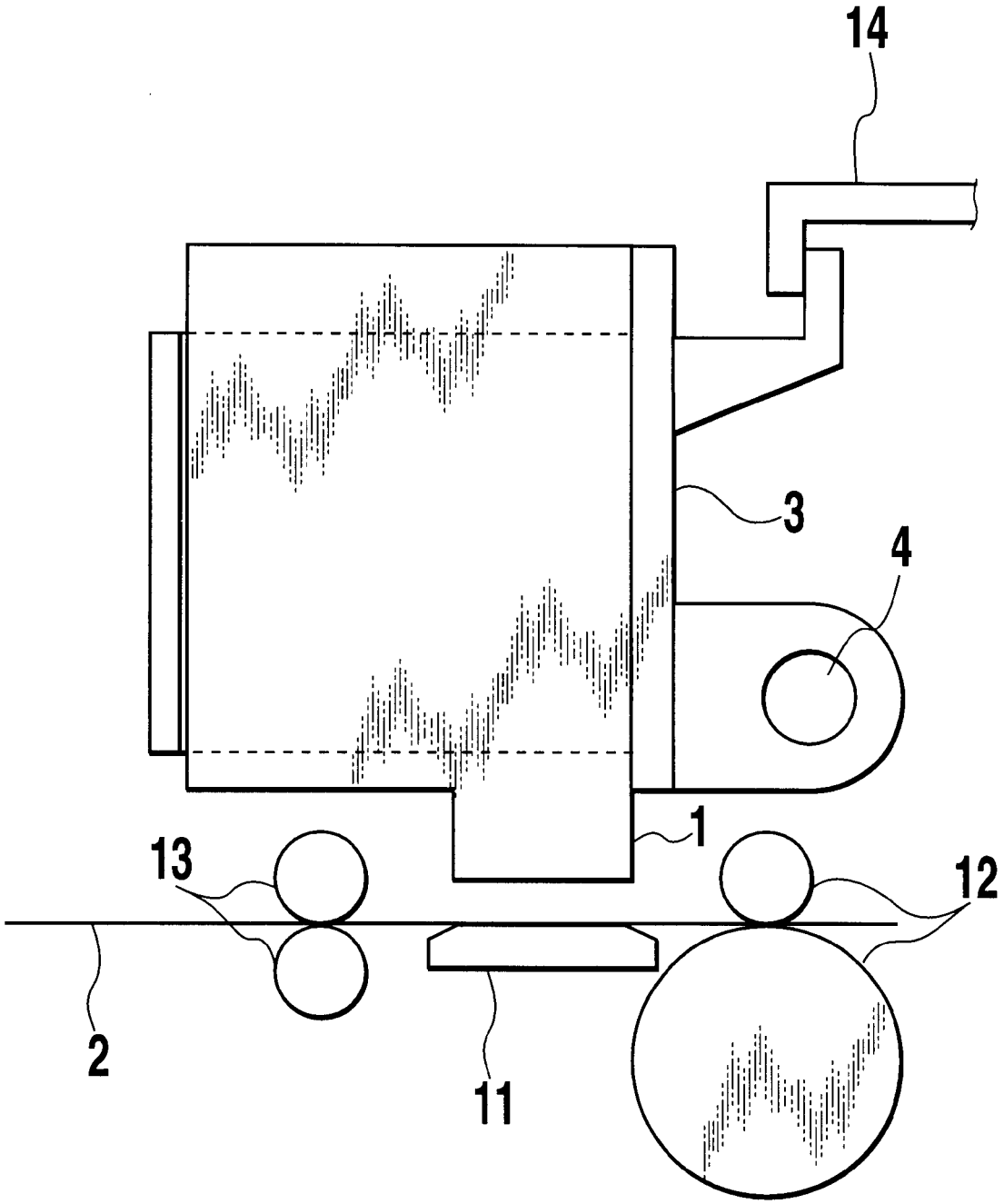
FIG. 11 is a cross section of the eighth embodiment of the ink jet printing apparatus according to the invention.

FIG. 11 shows a cross section of the ink jet printing machine. A recording medium 2 is supported on a platen 11 to keep the distance between the print head 1 and the recording medium 2 constant. The recording medium 2 is held and fed between a set of paper feed rollers 12 and a set of paper discharge rollers 13. Further, the carriage 3 is also supported and guided by a carriage guide 14 installed virtually above the carriage shaft 4.

Figure 12:
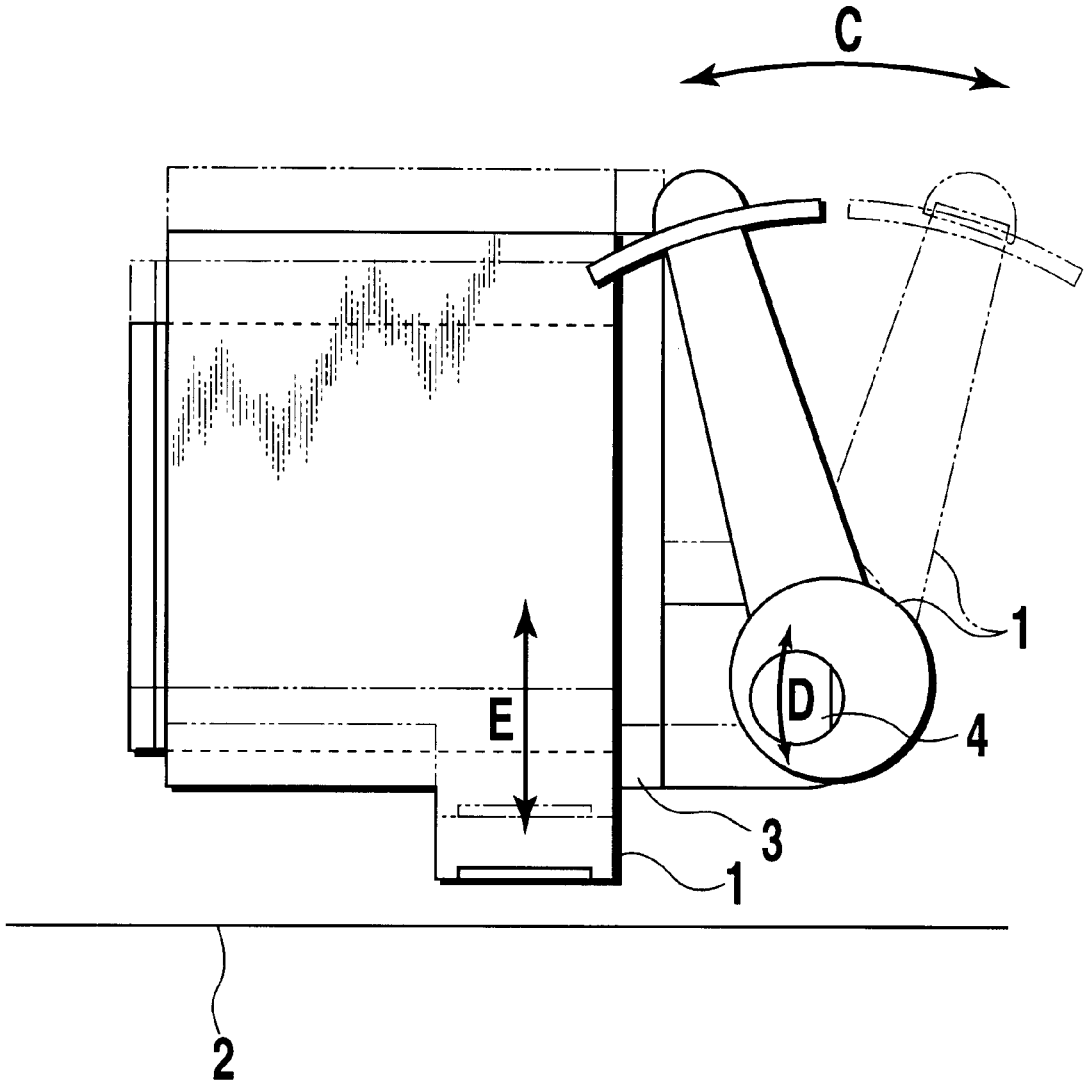
FIG. 12 is a cross section showing a distance selector mechanism for selecting a distance between the print head and the recording medium in the eighth embodiment of the ink jet printing apparatus according to the invention.

FIG. 12 shows a cross section of a selector mechanism for changing the distance between the print head 1 and the recording medium 2. This selector mechanism has a position adjust lever 15 for the print head 1. The carriage shaft 4 is mounted at its end to a frame 16 (FIG. 9) through the position adjust lever 15 of the print head 1. The carriage shaft 4 is offset from the rotating center of the position adjust lever 15 on the frame 16. Rotating the position adjust lever 15 of the print head 1 in the direction of arrow C in FIG. 12 causes the carriage shaft 4 to pivot in the direction of arrow D, with the result that the carriage 3 and the print head 1 move relative to the recording medium 2 in the direction of arrow E. It is important to ensure that the direction in which the ink is ejected from the nozzles 1*a* of the print head 1 to the recording medium 2 does not change significantly before and after the lever operation. The ink ejection directions from the nozzles 1*a* of the print head 1 to the recording medium 2 before and after the lever operation can be made almost equal by disposing the carriage shaft 4 and the carriage guide 14 as the guides for the carriage 3 in a virtually vertical arrangement to make almost equal the horizontal positions of the carriage shaft 4 associated with the selected positions of the position adjust lever 15.

FIGS. 13 and 14 are cross sections of the wiper blade unit 9 showing the wiping states.

FIG. 13 represents wiping states when the distance between the print head 1 and the recording medium 2 is set smallest by the position adjust lever 15 of the print head 1.

Figure 13A:
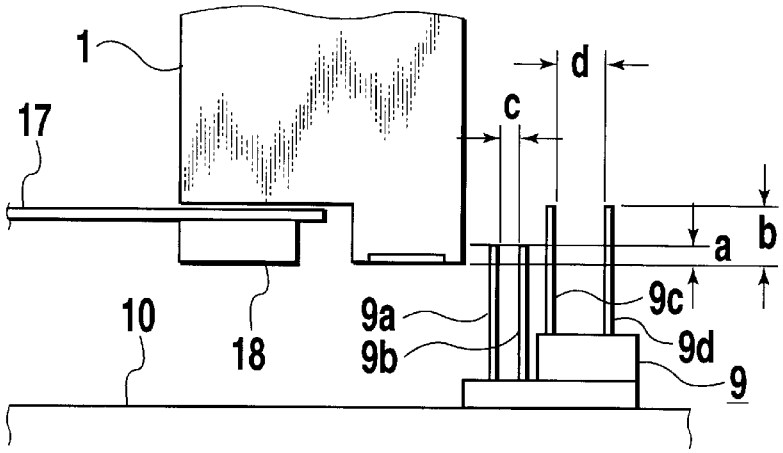
FIGS. 13A, 13B and 13C are cross sections of a wiper blade unit in the eighth embodiment of the ink jet printing apparatus according to the invention, showing the wiping state, with FIG. 13A representing a state before wiping, FIG. 13B representing a state at the start of wiping, and FIG. 13C representing a state during wiping.

FIG. 13A shows the state before the wiping is started, with the free ends of the wiper blades 9*a, 9b* set a distance a above the nozzle-formed face of the print head 1 and with the free ends of the wiper blades 9*c, 9d* set a distance b above the nozzle-formed face of the print head 1. The wiper blades 9*a* and 9*b* are spaced a distance c from each other and the wiper blades 9*c* and 9*d* are spaced a distance d from each other. Further, the wiper blades 9*a, 9b, 9c, 9d* are formed to have the same lengths and the same thicknesses.

Figure 13B:
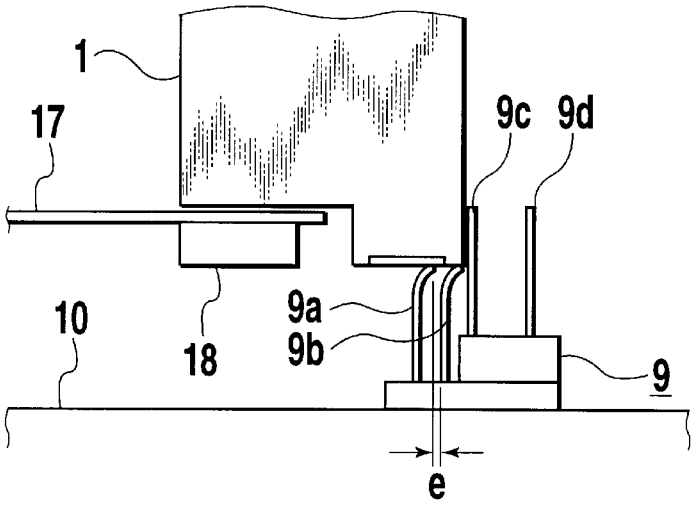

In the state of FIG. 13B reached by driving the wiper blade unit 9 along the wiper blade guide 10, the wiper blades 9*a* and the wiper blade 9*b* engage the nozzle-formed face 1*b* of the print head 1 and, in a deflected condition, wipe the nozzle-formed face 1*b*. In this case, the distance a is so set that the good wiping operation can be performed when the print head 1 is situated closest to the recording medium 2. In more concrete terms, the distance a is set in such a manner that, during the wiping of the print head 1, the engagement angles of the wiper blades 9*a, 9b* and the wiping forces acting on the print head 1 are in appropriate conditions. During wiping, the free end of the wiper blade 9*a* is a distance e from the wiper blade 9*b* and the distance c is therefore determined so that the wiper blade 9*a* and the wiper blade 9*b* do not contact and interfere with each other.

Figure 13C:
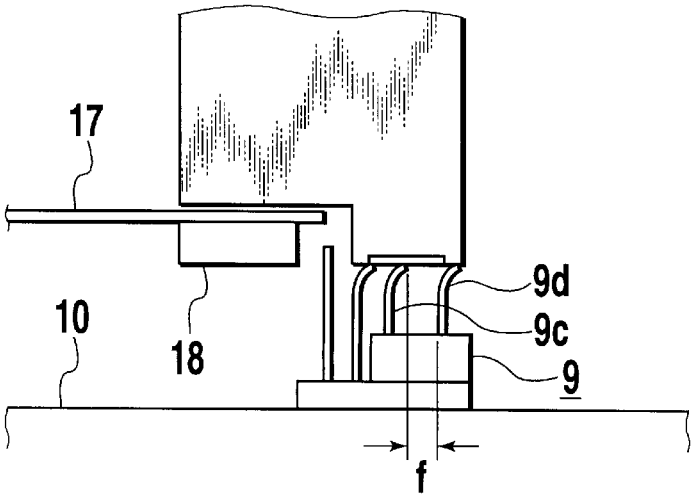

Further, in the state of FIG. 13C reached by further driving the wiper blade unit 9 along the wiper blade guide 10, the wiper blade 9*c* and the wiper blade 9*d* engage the nozzle-formed face 1*b* of the print head 1 and, in a deflected condition, wipe the nozzle-formed face 1*b*. At this time, the free end of the wiper blade 9*c* is a distance f from the wiper blade 9*d* during wiping and the distance d is therefore determined so that the wiper blade 9*c* and the wiper blade 9*d* do not contact and interfere with each other. When the print head 1 is closest to the recording medium 2, the wiper blade 9*c* and the wiper blade 9*d* wipe the face which was already wiped by the wiper blade 9*a* and the wiper blade 9*b*.

The wiper blade unit 9 is further driven along the wiper blade guide 10 to the area of a wiper blade cleaner 18 provided to a wiper blade cleaner support plate 17. The wiper blade cleaner 18 is wiped in a manner similar to the print head 1 to transfer ink and foreign matters adhering to the wiper blades 9*a, 9b, 9c, 9d* onto the wiper blade cleaner 18, thus cleaning the wiper blades 9*a, 9b, 9c, 9d*. The wiper blade cleaner support plate 17 encloses the cleaning area to prevent the scattering of ink when the wiper blades 9*a, 9b, 9c, 9d* part from the print head 1 and snap back.

When the print head 1 is situated closest to the recording medium 2, a satisfactory wiping can be performed by the wiper blades 9*a, 9b*.

FIG. 14 shows wiping states when the distance between the print head 1 and the recording medium 2 is set largest by the position adjust lever 15 of the print head 1.

Figure 14A:
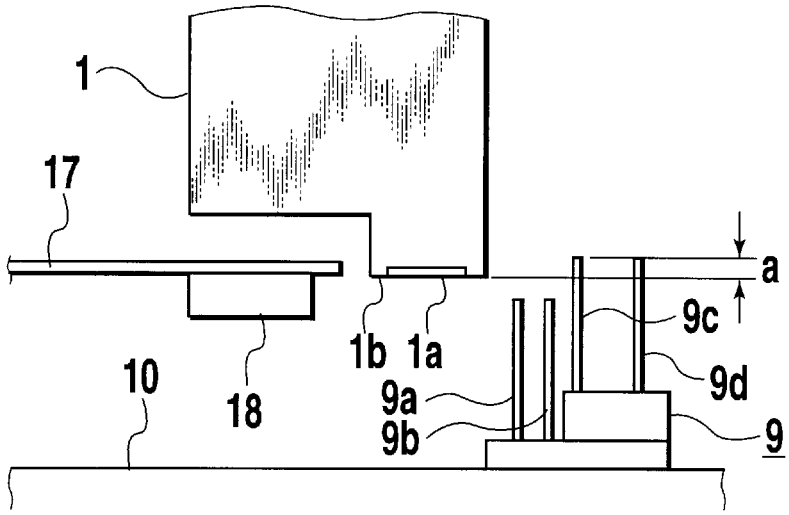
FIGS. 14A, 14B and 14C are cross sections of a wiper blade unit in the eighth embodiment of the ink jet printing apparatus according to the invention, showing the wiping state, with FIG. 14A representing a state before wiping, FIG. 14B representing a state at the start of wiping, and FIG. 14C representing a state during wiping.

FIG. 14A shows the state before the wiping is started, with the free ends of the wiper blades 9*c, 9d* set a distance a above the nozzle-formed face 1*b* of the print head 1.

Figure 14B:
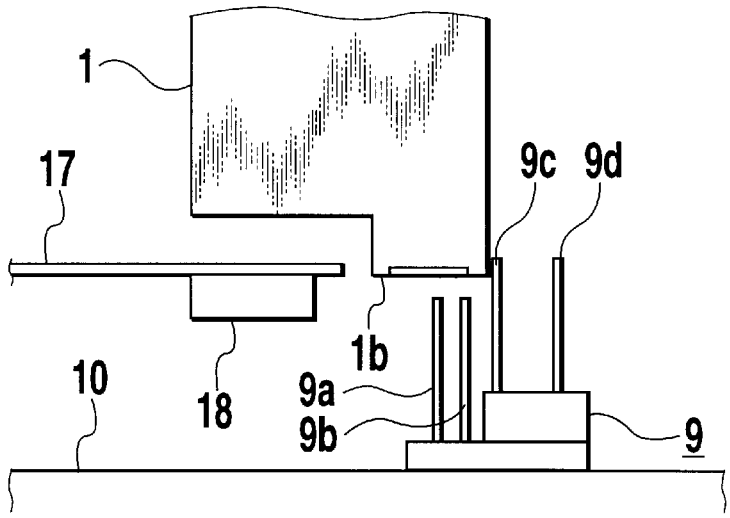

In the state of FIG. 14B reached by driving the wiper blade unit 9 along the wiper blade guide 10, the wiper blade 9*a* and the wiper blade 9*b* do not engage the nozzle-formed face 1*b* of the print head 1.

Figure 14C:
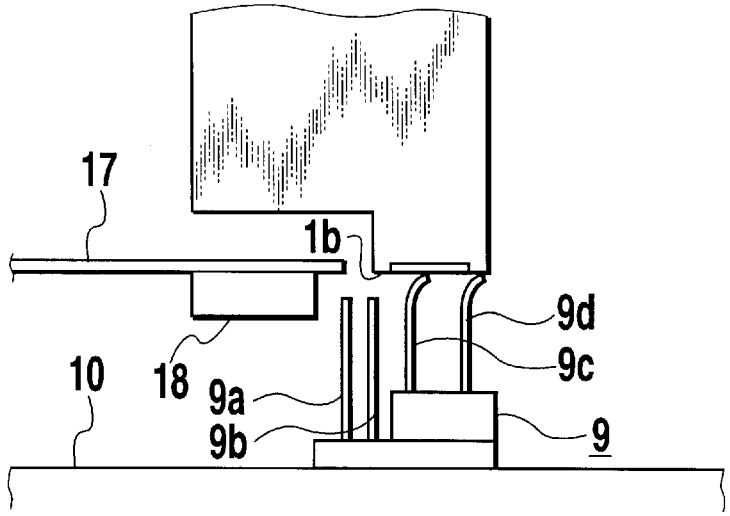

In the state of FIG. 14C reached by further driving the wiper blade unit 9 along the wiper blade guide 10, the wiper blade 9*c* and the wiper blade 9*d* engage the nozzle-formed face 1*b* of the print head 1 and, in a deflected condition, wipe the nozzle-formed face 1*b*. The distance a is so set that the wiping can be performed in good condition when the print head 1 is situated farthest from the recording medium 2. In more concrete terms, the distance a is set in such a manner that, during the wiping of the print head 1, the engagement angles of the wiper blades 9*c, 9d* and the wiping forces acting on the print head 1 are in appropriate conditions.

The wiper blade unit 9 is further driven along the wiper blade guide 10 to the area of a wiper blade cleaner 18 provided to a wiper blade cleaner support plate 17.

In this way, with the print head 1 set at a position closest to the recording medium 2, the wiping can be done in good condition by the wiper blades 9*c*, 9*d*.

Although this embodiment takes up an example case where the distance traveled by the print head 1 is greater than the distance a between the print head 1 and the free end of the wiper blade, the embodiment is also effective in a case where the moving distance of the print head 1 is smaller than the distance a between the print head 1 and the free end of the wiper blade. In this case, in the states of FIGS. 14B and 14C, the wiper blades 9*a*, 9*b* engage the print head 1 and become deflected. Although the wiping performed by the wiper blades 9*a*, 9*b* is not satisfactory, the remaining wiper blades perform the subsequent wiping.

Concrete wiper blade structural conditions for this embodiment that ensure good wiping are given below. The width is for example set at 14 mm for the nozzle wiper blades and 22 mm for the nozzle-formed face wiper blades (which depend on the configurations of the nozzles and the nozzle-formed face); the material of the wiper blades is be HNBR; the rubber harness is 75; the wiper blade thickness is 0.65 mm; the wiper blade length is 5.5 mm; and the distance between the free end of the wiper blade and the nozzle-formed face is set at 2 mm.

The thickness of the wiper blades is preferably in the range of 0.4 mm to 3 mm considering the molding conditions. The wiper blade material is preferably HNBR or chlorinated butyl rubber because of their ink resistance and durability. Further, the rubber hardness is preferably in the range of 35 to 85.

Further, as to the forces acting on the print head when the wiper blade engages it, a proper value should be determined according to the structure of the nozzle-formed face of the print head. In terms of durability, the wiping force is restricted depending on the material of the nozzle-formed face.

The print head of the ink jet printing apparatus according to this invention is an ink jet printing means that utilizes thermal energy to eject ink and which has an electrothermal transducer for generating thermal energy. Further, in ejecting ink droplets from the nozzles for printing, this print head uses a change in pressure which is caused by the growth and collapse of a bubble formed by a boiling film generated by the thermal energy applied by the electrothermal transducer.

Embodiment 9

Figure 15:
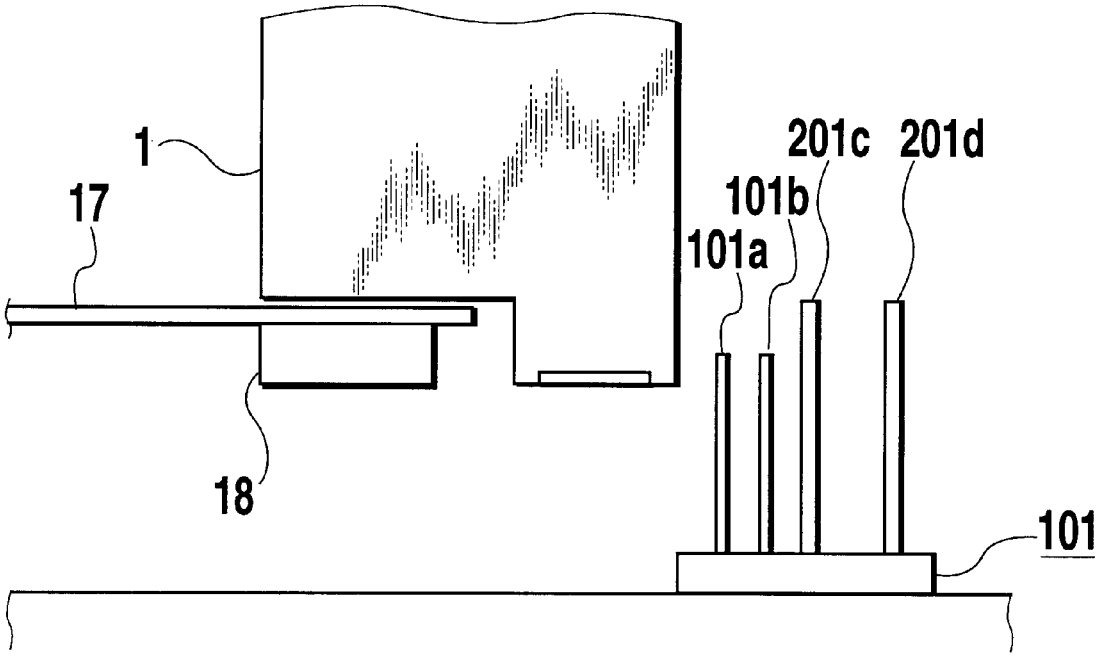
FIG. 15 is a side cross section showing a wiper blade unit in a ninth embodiment of the ink jet printing apparatus according to the invention.

FIG. 15 shows a wiper blade unit 101 of a ninth embodiment of the ink jet printing apparatus according to the invention. The wiper blade unit 101 comprises a plurality of wiper blades 110*a*, 101*b*, 101*c*, 101*d*. These wiper blades 101*a*, 101*b*, 101*c*, 101*d* consist of two kinds of wiper blades with different lengths. The wiper blades 101*a* and 101*b* are equal in length and the wiper blades 101*c* and 101*d* are equal in length. The wiper blades 101*a*, 101*b* are somewhat shorter than the wiper blades 101*c*, 101*d*. These wiper blades 101*a*, 101*b*, 101*c*, 101*d* are mounted at the same height. The thicknesses of the wiper blades 101*a*, 101*b*, 101*c*, 101*d* are set so that the engagement conditions of the wiper blades 101*a*, 101*b* when the print head 1 is at the lowest position are almost equal to the engagement conditions of the wiper blades 101*c*, 101*d* when the print head 1 is at the highest position. In other words, the engagement angle and the acting force of the first group of wiper blades are nearly equal to those of the second group.

By properly setting the thicknesses and the geometries of the free ends of the wiper blades so that the forces of the wiper blades are almost equal, the engagement angles can be made virtually equal.

Further, by properly setting the hardnesses of the wiper blades, it is possible to make the forces virtually equal. Therefore, the engagement conditions of individual wiper blades for a selected height of the print head can be made almost equal by properly selecting the length, thickness, width, hardness, and free end geometry according to the selected height of the print head.

Embodiment 10

Figure 16:
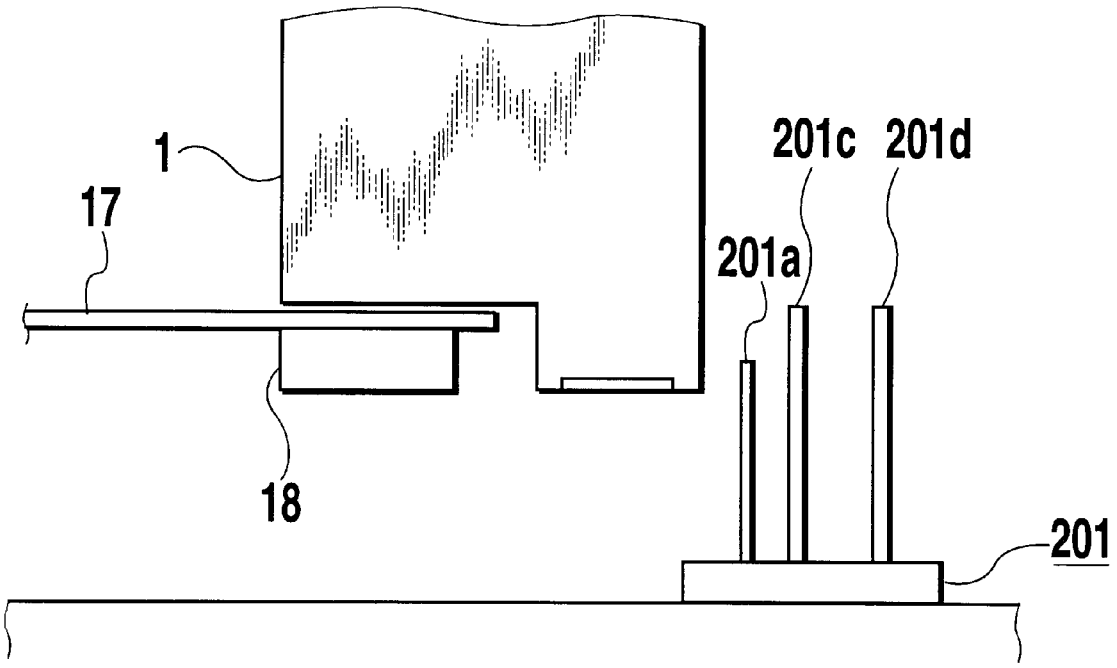
FIG. 16 is a side cross section showing a wiper blade unit in a tenth embodiment of the ink jet printing apparatus according to the invention.

FIG. 16 shows a wiper blade unit 201 of a tenth embodiment of the ink jet printing apparatus according to the invention. In this embodiment, the wiper blade 101*d* in FIG. 15 doubles as the wiper blade 101*b* for cleaning the nozzle-formed face. As to the cleaning of the nozzle-formed face of the print head, because the effects the wiping performance has on the print head performance and print quality are smaller than when cleaning the nozzles, the use of one wiper blade for two functions has no adverse effect on the performance of the printing apparatus. In this case, the number of the wiper blades 201*a*, 201*b*, 201*c* is reduced, the durability of the nozzles and nozzle-formed face of the print head 1 improves.

Embodiment 11

Figure 17:
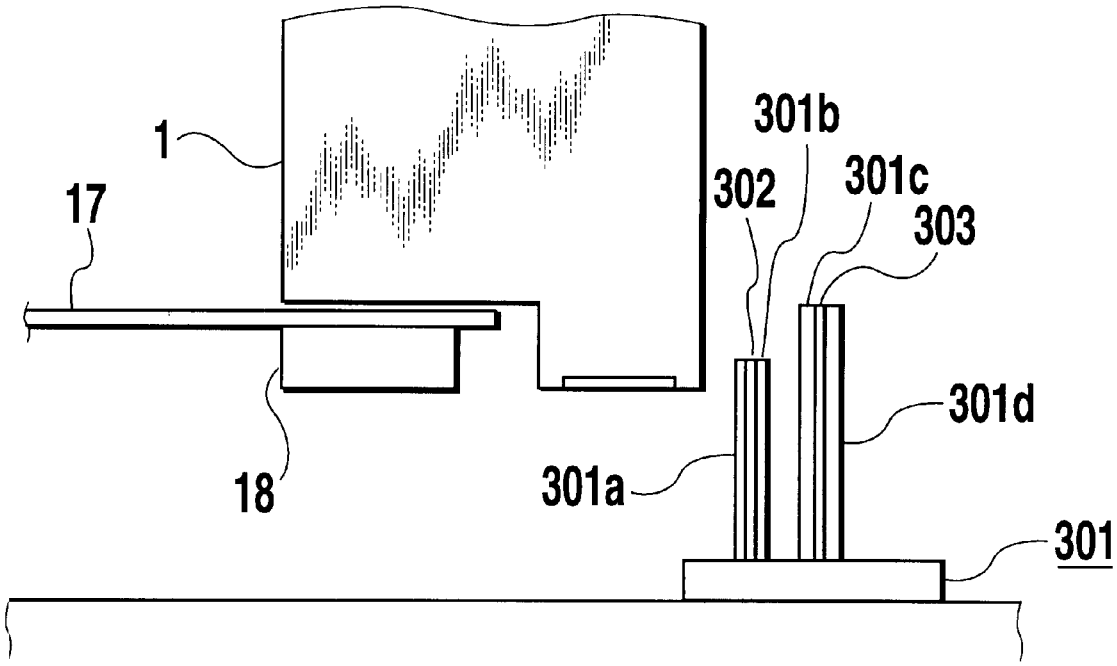
FIG. 17 is a side cross section showing a wiper blade unit in an eleventh embodiment of the ink jet printing apparatus according to the invention.

FIG. 17 shows a wiper blade unit 301 of an eleventh embodiment of the ink jet printing apparatus according to the invention. Wiper blades 301*a*, 301*b* are held together with an absorbent body 302 interposed therebetween and wiper blades 301*c*, 301*d* are held together with an absorbent body 303 sandwiched therebetween. In this case, the wiper blade 301*a* does not deflect alone but deforms together with the wiper blade 301*b* and the absorbent body 302, thereby producing a greater force. Because the sandwiched absorbent bodies 302, 303 absorb the ink adhering to the wiper blades while the wiper blades engage and wipe the print head 1, the scattering of ink at the end of wiping is reduced.

Embodiment 12

Figure 18:
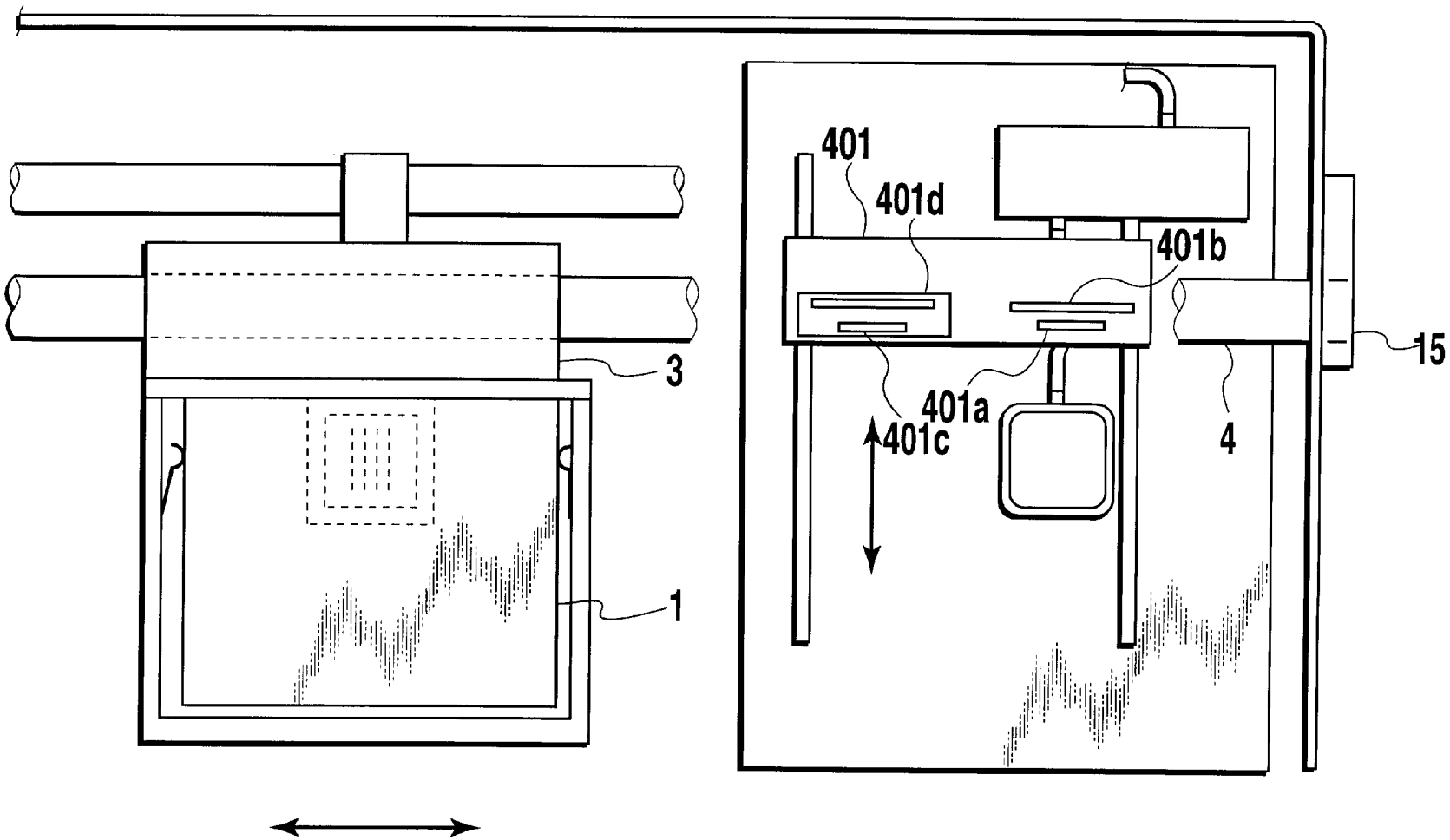
FIG. 18 is a side cross section showing a wiper blade unit in a twelfth embodiment of the ink jet printing apparatus according to the invention.

FIG. 18 shows a wiper blade unit 401 of a twelfth embodiment of the ink jet printing apparatus according to the invention. Wiper blades 401*a*, 401*b* and wiper blades 401*c*, 401*d* are separated from each other in the direction of movement of the carriage 3 and the position of the carriage 3 is changed according to the height of the print head 1 to select the wiper blades to be used for wiping. Thus, the wiping can be performed according to the height of the print head 1 by only the optimum wiper blades and thus the durability against the wiping improves. Further, the stroke of the wiping is shortened, which in turn reduces the processing time.

The height of the print head 1 may be detected by using a sensor that detects the positions of the position adjust lever 15 and of the carriage shaft 4, or may be set on a printer driver in a computer or set by providing a switch on the printing apparatus.

Embodiment 13

Figure 19:
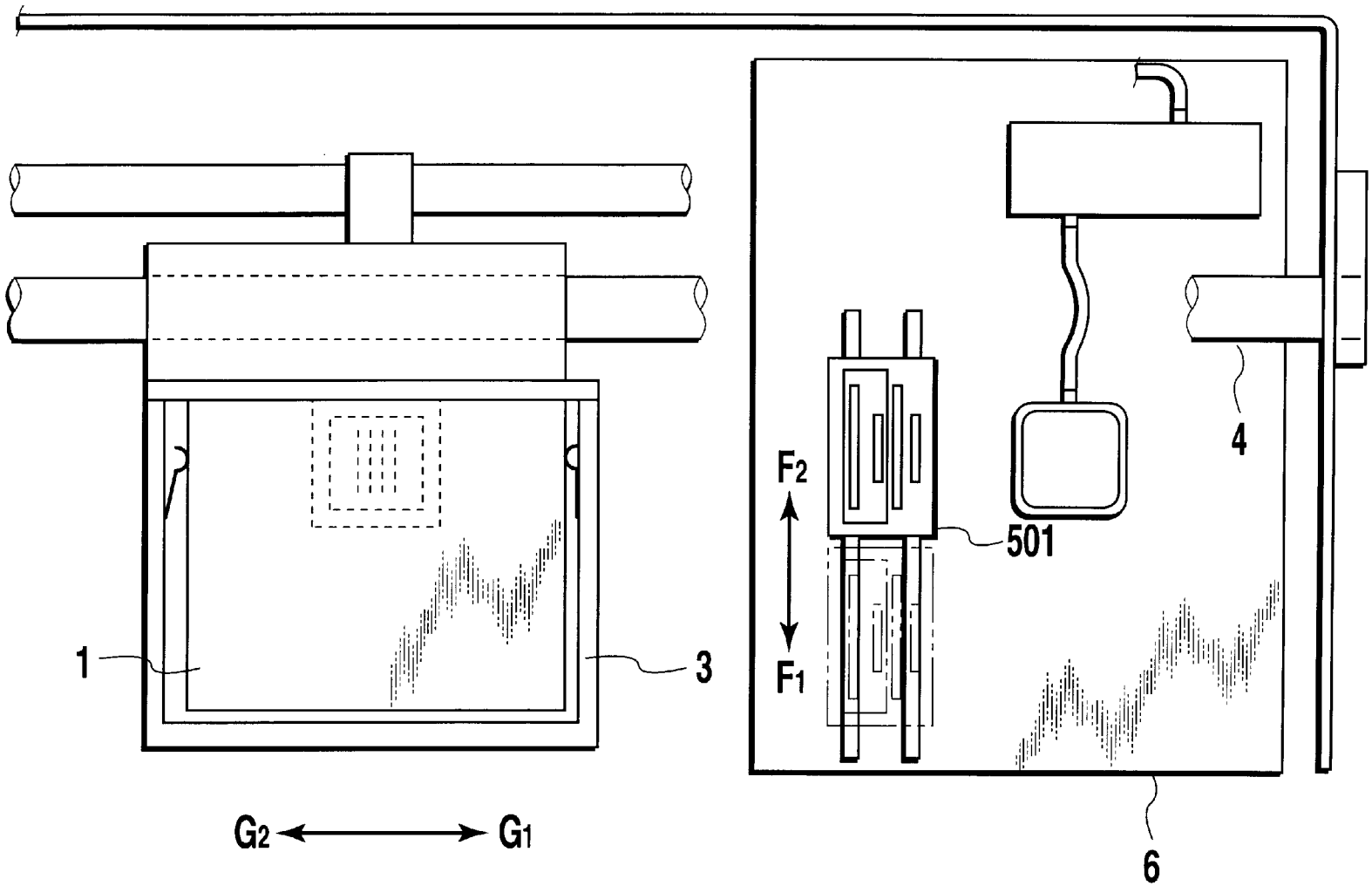
FIG. 19 is a side cross section showing a wiper blade unit in a thirteenth embodiment of the ink jet printing apparatus according to the invention.
Figure 20:
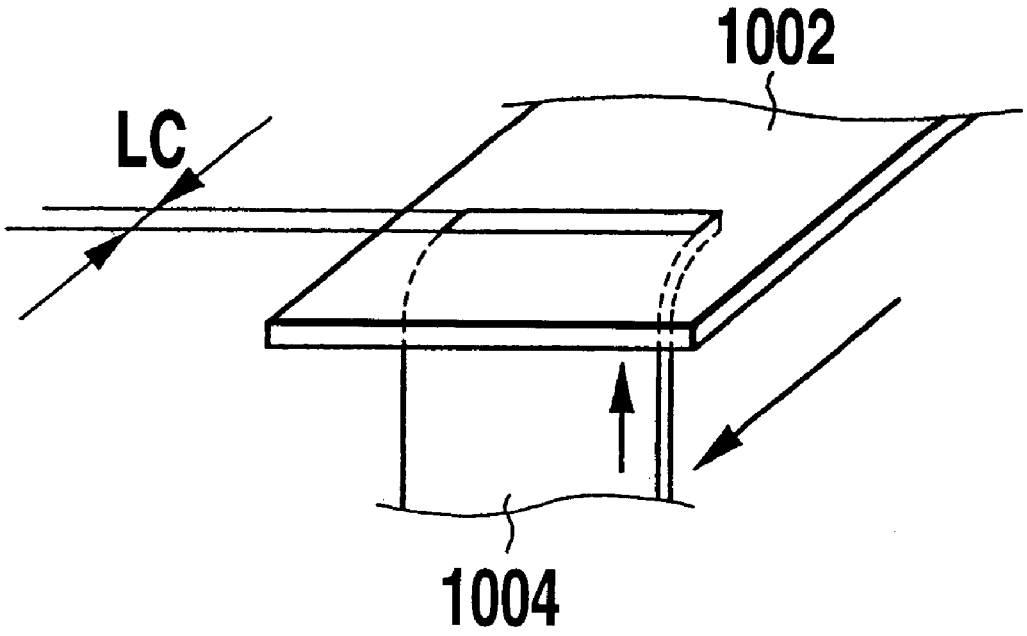
FIG. 20 is a schematic diagram used for explaining the contact state of a conventional wiper blade.
Figure 21A:
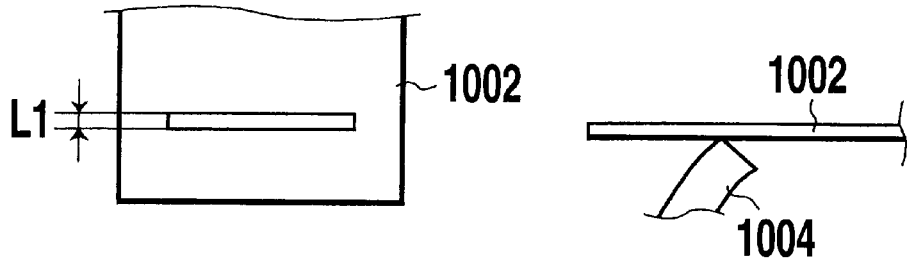
FIGS. 21A, 21B and 21C are schematic diagrams showing the contact states of the conventional wiper blade.
Figure 21B:
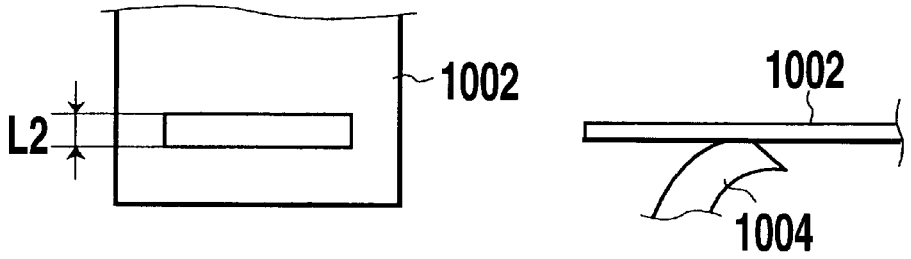
Figure 21C:
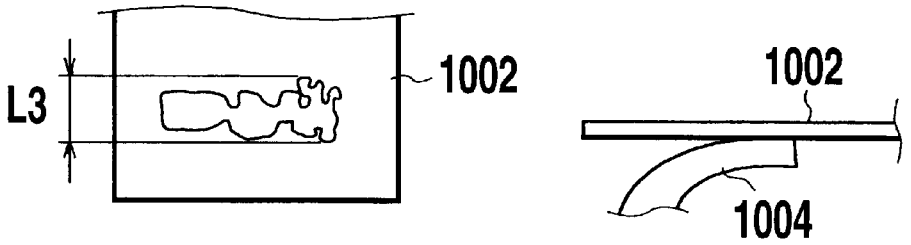
Figure 22A:
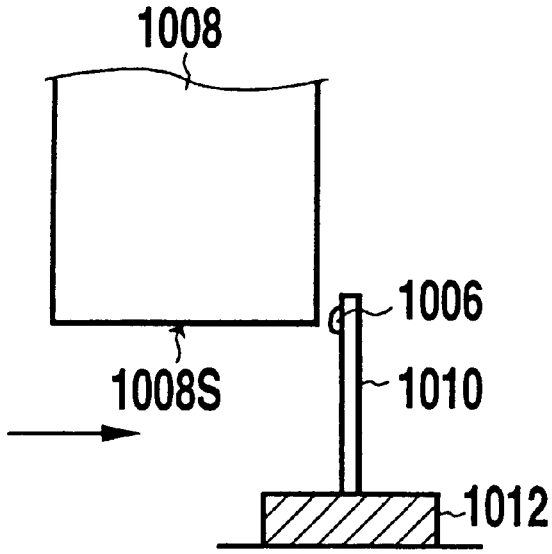
FIG.22A PRIOR ART
FIGS. 22A, 22B and 22C are schematic diagrams showing the contact states of the conventional wiper blade.
Figure 22B:
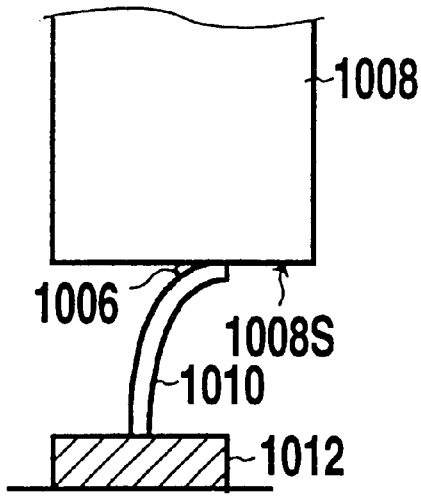
FIG.22B PRIOR ART
Figure 22C:
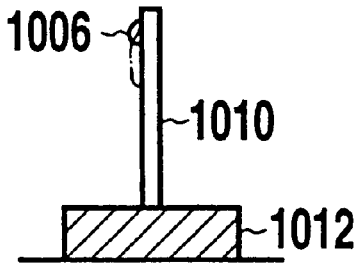
FIG.22C PRIOR ART
Figure 23:
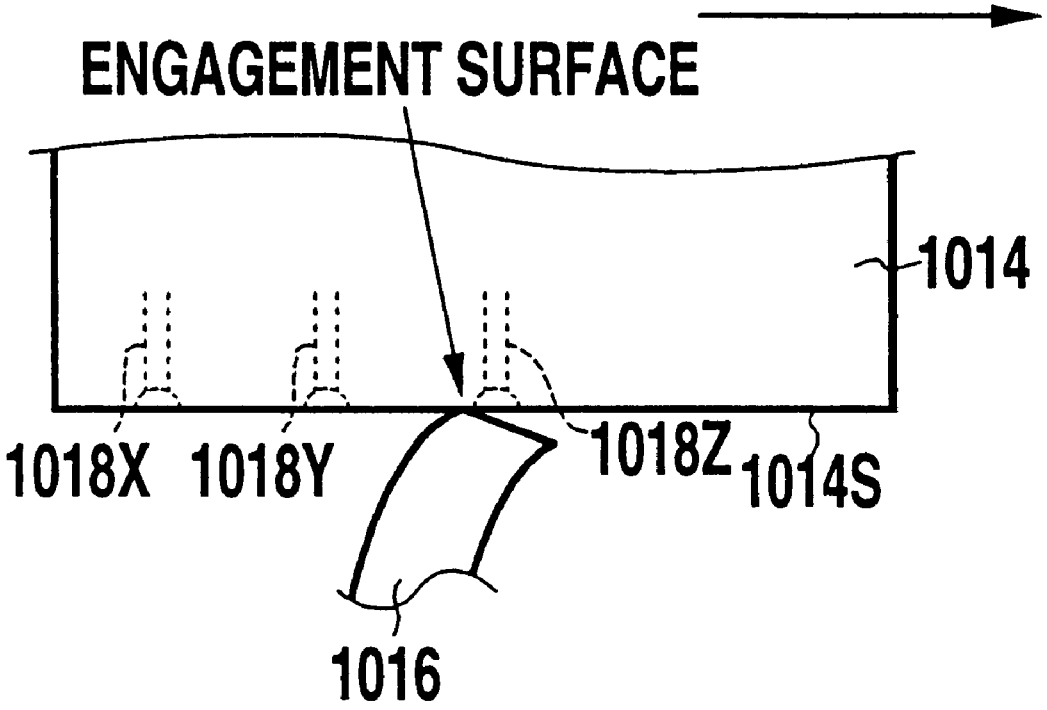
FIG.23 PRIOR ART
FIG. 23 is a schematic diagram used for explaining the cleaning operation of the conventional wiper blade.
Figure 24A:
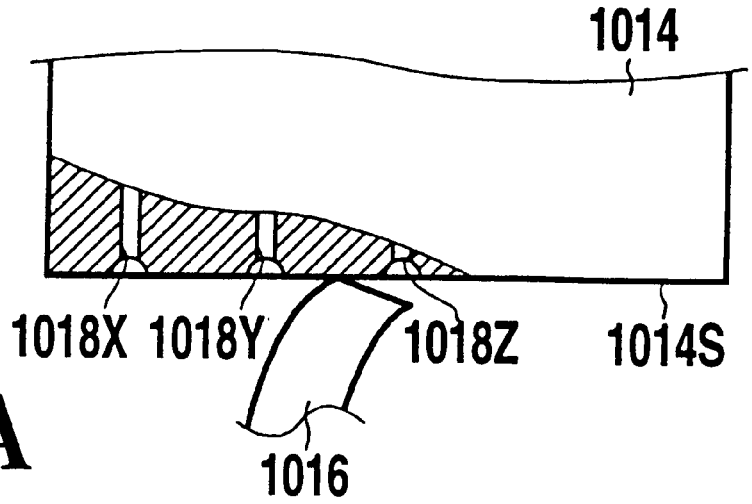
FIG.24A PRIOR ART
FIGS. 24A, 24B and 24C are schematic diagrams showing the cleaning operation of the conventional wiper blade.
Figure 24B:
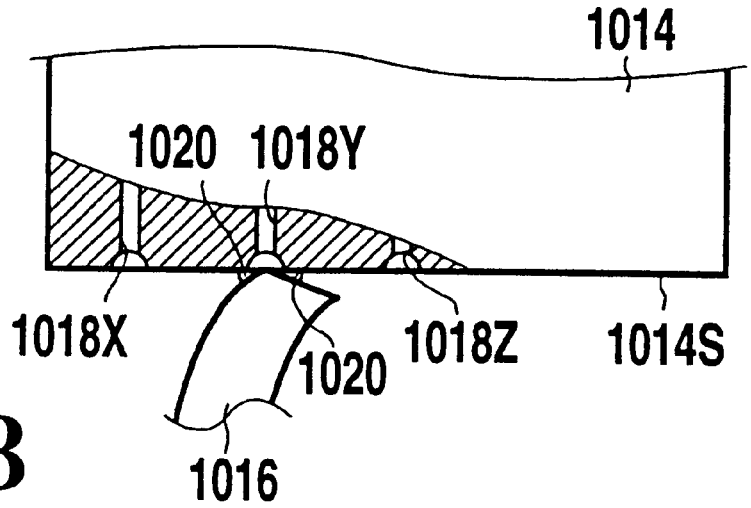
FIG.24B PRIOR ART
Figure 24C:
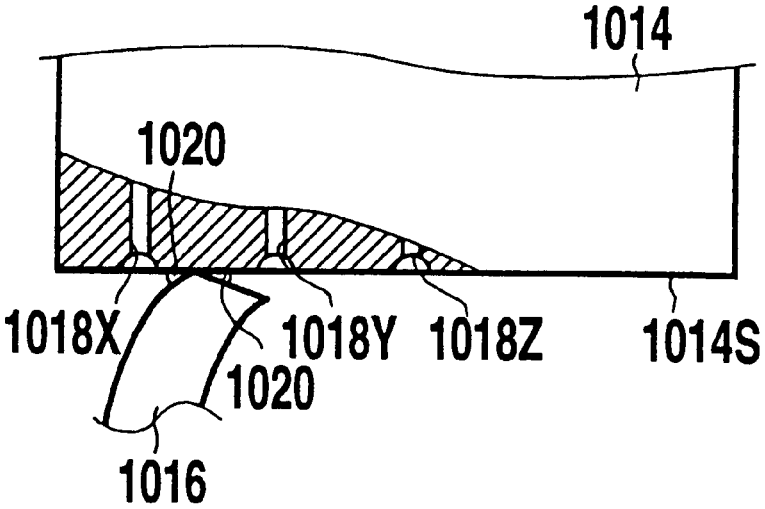
FIG.24C PRIOR ART
Figure 25A:
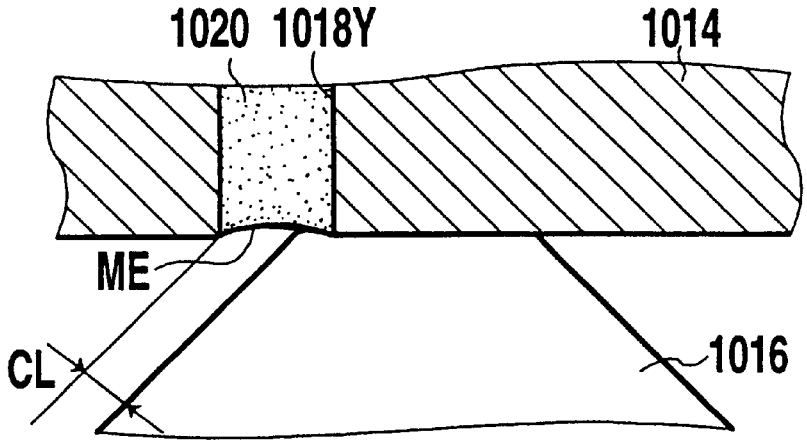
FIG.25A PRIOR ART
FIGS. 25A, 25B and 25C are partially enlarged views showing the cleaning operation of the conventional wiper blade.
Figure 25B:
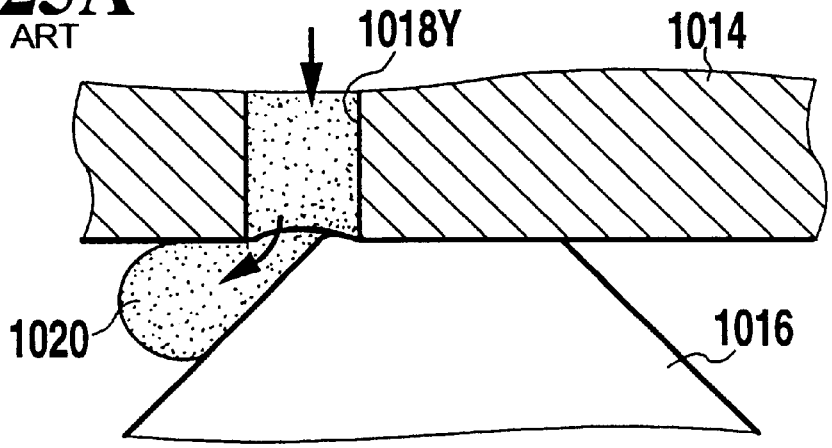
FIG.25B PRIOR ART
Figure 25C:
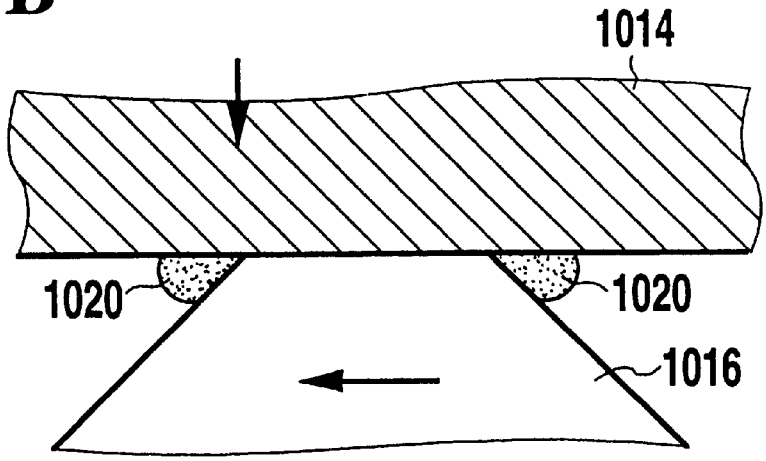
FIG.25C PRIOR ART
Figure 26A:
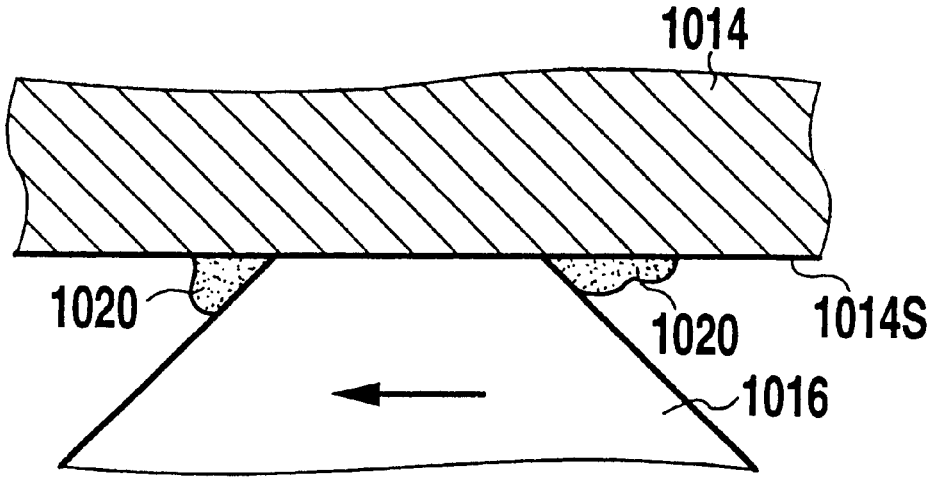
FIG.26A PRIOR ART
FIGS. 26A and 26B are partially enlarged views showing the cleaning operation of the conventional wiper blade.
Figure 26B:
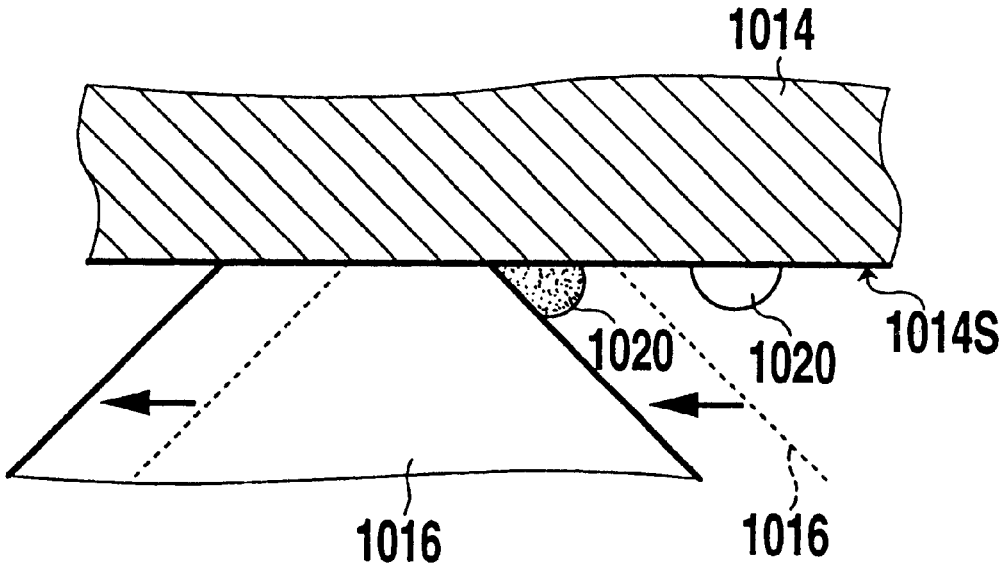
FIG.26B PRIOR ART
Figure 28:
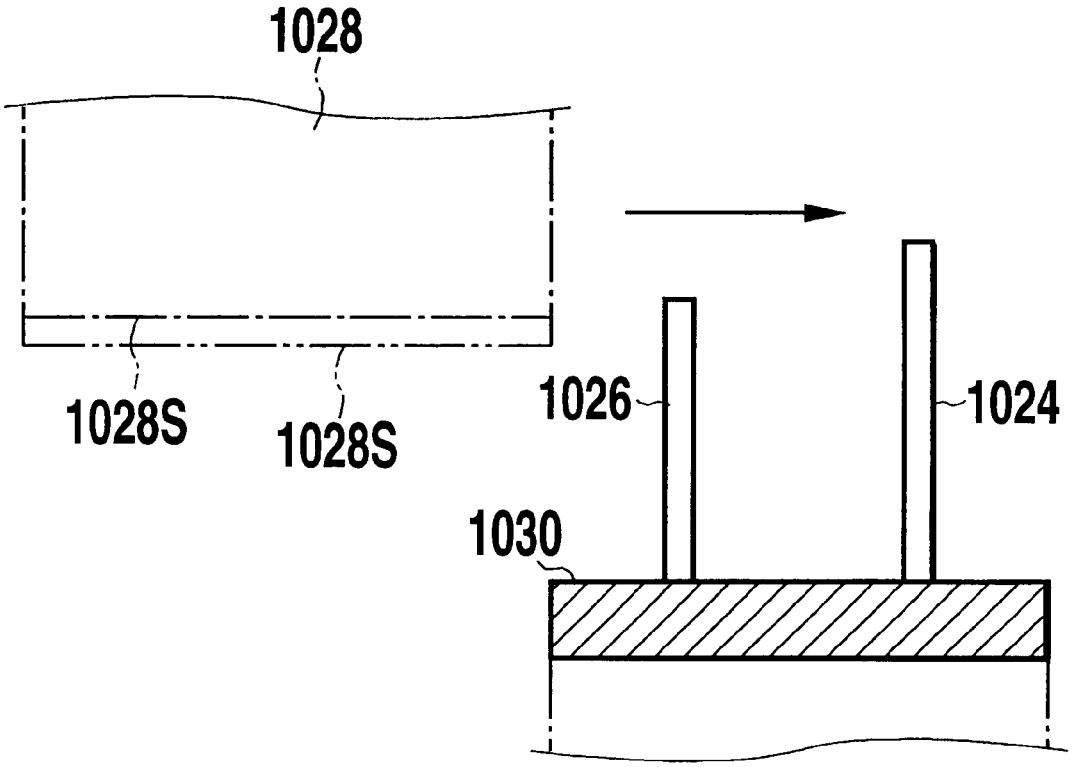
FIG. 28 is a schematic diagram showing the arrangement of a plurality of conventional wiper blades in connection with the print head.
Figure 29A:
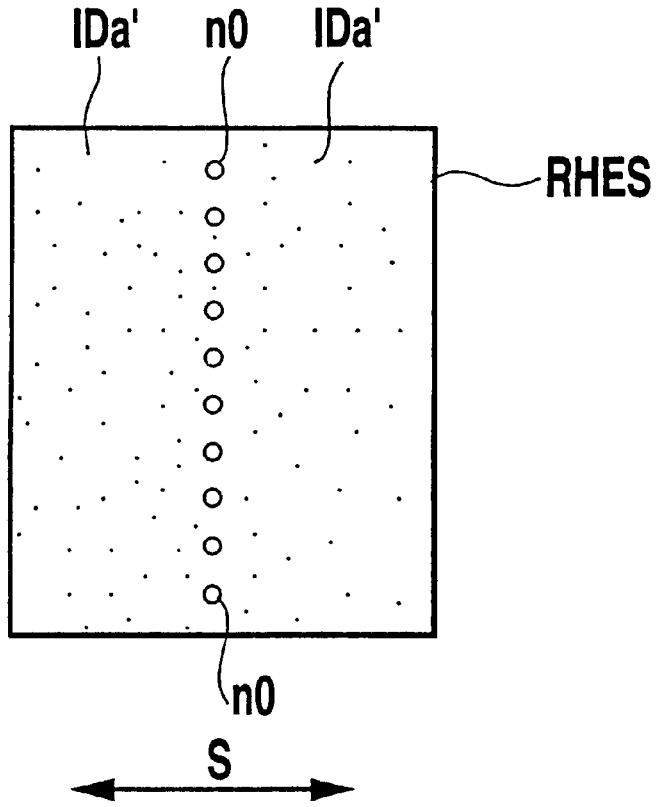
FIG.29A PRIOR ART
FIGS. 29A and 29B are schematic diagrams showing ink droplets adhering to the nozzle-formed face of the conventional print head.
Figure 29B:
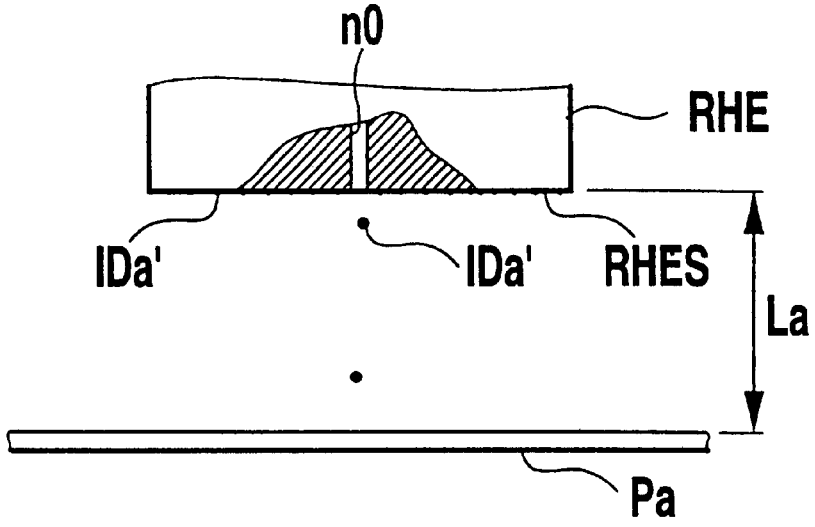
FIG.29B PRIOR ART
Figure 30A:
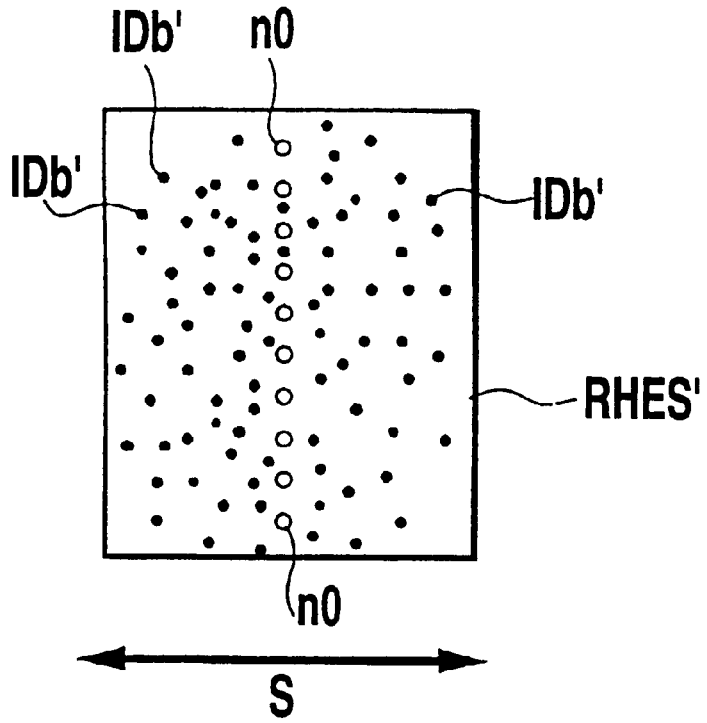
FIG.30A PRIOR ART
FIGS. 30A and 30B are schematic diagrams showing ink droplets adhering to the nozzle-formed face of the conventional print head.
Figure 30B:
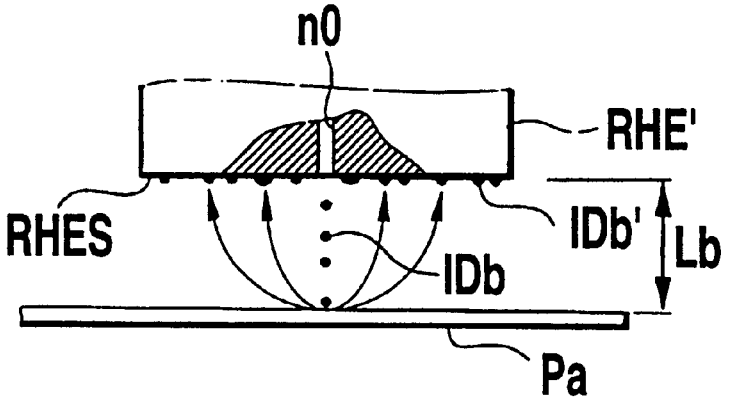
FIG.30B PRIOR ART

FIG. 19 shows a wiper blade unit 501 of a thirteenth embodiment of the ink jet printing apparatus according to the invention.

In the thirteenth embodiment, the wiper blade unit 501 is the wiper blade unit 9 of FIG. 9 rotated through 90 degrees. With the wiper blade unit 501 retracted from the reciprocating area for the print head 1 (at F1 in the figure), the carriage 3 is moved to the ejection recovery unit position, then the wiper blade unit 501 is moved into the reciprocating area for the print head 1 (at F2 in the figure) and the carriage 3 is moved away from the ejection recovery unit 6 to wipe the print head 1. The scattering of ink after the wiping occurs only in the non-printing region and no ink is scattered toward the recording medium 2. The wiping direction in this configuration differs from the one shown in FIG. 9 by 90 degrees. In this construction, the width of the wiping mechanism can be reduced, which in turn allows reduction in the width of the apparatus.

As can be seen from the above, according to a cleaning method and a cleaning device of the ink jet printing apparatus using the cleaning method, because the contact width of the wipe portion of a second cleaning member obtained when the distance between the liquid nozzle-formed face of a print unit and the recording surface is adjusted to a first distance and the contact width of the wipe portion of a first cleaning member obtained when the distance between the liquid nozzle-formed face of the print unit and the recording surface is adjusted to a second distance, larger than the first distance, are set almost equal, the contact widths of the cleaning members can be made appropriate values according to the distance between the nozzle-formed face of the print head and the surface of the recording medium even when the distance is changed.

Further, because, based on the amount of a substance adhering to the liquid nozzle-formed face of the print unit and the distance between the liquid nozzle-formed face of the print unit and the recording surface, the contact widths of the wipe portions of the first cleaning member and the second cleaning member are individually set so that the wiping state of at least one of the wipe portions of the first cleaning member and the second cleaning member differs from the wiping state of the other, it is possible to clean the liquid nozzle-formed face of the print unit under a wiping condition suited for individual print heads with different average print duty values.

Further, because, based on whether what adheres to the liquid nozzle-formed face of the print unit is a dye ink or a pigment ink and the distance between the liquid nozzle-formed face of the print unit and the recording surface, the contact widths of the wipe portions of the first cleaning member and the second cleaning member are individually set so that the wiping state of at least one of the wipe portions of the first cleaning member and the second cleaning member differs from the wiping state of the other, it is possible to clean the liquid nozzle-formed face of the print unit reliably under a wiping condition suited for the dye ink or the pigment ink used for printing.

Further, according to the ink jet printing apparatus of this invention, which comprises a print means for ejecting ink from nozzles onto a recording medium for printing, an ejection recovery means for recovering the ejection performance by engaging the print means, a selector mechanism for selecting a distance between the print head and the recording medium, and a cleaning means having a plurality of cleaning members such as wiper blades, the cleaning members having different free end positions, lengths and/or thicknesses according to the distance between the print head and the recording medium; the free ends of the plurality of cleaning members are positioned so that the forces, deflections and engagement angles of the cleaning members when they engage the print head are virtually equal among the cleaning members; an absorbent body is arranged between the cleaning members; the cleaning members are arranged in the direction of movement of the print head and the cleaning member to be used is selected by the carriage position according to the distance between the print head and the recording medium; and the distance that the print head is moved by the print head position selector mechanism and the height difference between the cleaning members are set almost equal. Because of this arrangement, the print head can be wiped by the cleaning members in good condition at all times without loading the print head and the carriage regardless of the selected print head position.

This invention can also be applied to a printing apparatus having a print means (print head) using an electrothermal transducer such as piezoelectric element as long as the printing apparatus is an ink jet printing apparatus. This invention is particularly effective when applied to an ink jet printing apparatus of a type that uses thermal energy in ejecting ink. This is because such a system can achieve higher density and higher resolution of printing.

The present invention has been described in detail with respect to preferred embodiments, and it will now be apparent from the foregoing to those skilled in the art that changes and modifications may be made without departing from the invention in its broader aspect, and it is the invention, therefore, in the apparent claims to cover all such changes and modifications as fall within the true spirit of the invention.

What is claimed is:

1. A cleaning method comprising the steps of:

when a distance between a liquid nozzle-formed face of a print unit, which performs printing on a recording surface of a recording medium, and the recording surface is adjusted to a first distance, wiping off a substance adhering to the liquid nozzle-formed face by a first cleaning member and then by a second cleaning member, the first cleaning member being arranged movable relative to the liquid nozzle-formed face of the print unit, the second cleaning member being adapted to wipe off the substance adhering to the liquid nozzle-formed face following the first cleaning member, the first and second cleaning members having different contact widths; and when the distance between the liquid nozzle-formed face of the print unit and the recording surface is adjusted to a second distance, larger than the first distance, setting the contact width of a wipe portion of the first cleaning member virtually equal to the contact width of a wipe portion of the second cleaning member associated with the first distance and wiping off the adhering substance.

2. A cleaning method according to claim 1, wherein, when the distance between the liquid nozzle-formed face of the print unit and the recording surface is adjusted to the first distance, the contact width of the first cleaning member is set larger than the contact width of the second cleaning member.

3. A cleaning method according to claim 2, wherein the first cleaning member and the second cleaning member have virtually equal shape dimensions.

4. A cleaning method according to claim 1, wherein the first cleaning member and the second cleaning member are made of elastic materials and formed into a shape of plate.

5. A cleaning method according to claim 4, wherein a thickness of the first cleaning member is set smaller than a thickness of the second cleaning member so that, even when the distance between the liquid nozzle-formed face of the print unit and the recording surface is changed, a wiping state of at least one of the wipe portions of the first cleaning member and the second cleaning member remains almost equal to a wiping state before the change of the distance.

6. A cleaning method according to claim 4, wherein a hardness of the first cleaning member is set smaller than a hardness of the second cleaning member so that, even when the distance between the liquid nozzle-formed face of the print unit and the recording surface is changed, a wiping state of at least one of the wipe portions of the first cleaning member and the second cleaning member remains almost equal to a wiping state before the change of the distance.

7. A cleaning method according to claim 1, wherein the contact widths of the wipe portions of the first cleaning member and the second cleaning member are individually set based on the amount of substance adhering to the liquid nozzle-formed face of the print unit and on the distance between the liquid nozzle-formed face of the print unit and the recording surface in such a manner that a wiping state of at least one of the wipe portions of the first cleaning member and the second cleaning member differs from a wiping state of the other.

8. A cleaning method according to claim 7, wherein, when the amount of adhering substance is relatively small and the distance between the liquid nozzle-formed face of the print unit and the recording surface is relatively large, an engagement pressure of at least one of the wipe portions of the first cleaning member and the second cleaning member is set larger than an engagement pressure of the other.

9. A cleaning method according to claim 1, wherein the contact widths of the wipe portions of the first cleaning member and the second cleaning member are individually set based on a dye ink or a pigment ink adhering to the liquid nozzle-formed face of the print unit and on the distance between the liquid nozzle-formed face of the print unit and the recording surface in such a manner that a wiping state of at least one of the wipe portions of the first cleaning member and the second cleaning member differs from a wiping state of the other.

10. A cleaning method according to claim 9, wherein, when the pigment ink adheres to the liquid nozzle-formed face of the print unit, an engagement pressure of at least one of the wipe portions of the first cleaning member and the second cleaning member is set larger than an engagement pressure of the other.

11. A cleaning device of an ink jet printing apparatus comprising:

a distance adjust mechanism for adjusting in two steps a distance between a liquid nozzle-formed face of a print unit, which performs printing on a recording surface of a recording medium, and the recording surface; and a cleaning member unit, the cleaning member unit further comprising:

a first cleaning member arranged movable relative to the liquid nozzle-formed face of the print unit and adapted to wipe off with a predetermined contact width a substance adhering to the liquid nozzle-formed face; and a second cleaning member for wiping off with a predetermined contact width the substance adhering to the liquid nozzle-formed face following the first cleaning member;

wherein when the distance between the liquid nozzle-formed face of the print unit and the recording surface is adjusted to a first distance, said predetermined contact width of the first cleaning member is set to be different from said predetermined contact width of the second cleaning member, and a contact width of the second cleaning member when adjusted to the first distance is set almost equal to a contact width of the first cleaning member when adjusted to a second distance which differs from the first distance.

12. A cleaning device of an ink jet printing apparatus according to claim 11, wherein, when the distance between the liquid nozzle-formed face of the print unit and the recording surface is adjusted to the first distance, the contact width of the first cleaning member is set larger than the contact width of the second cleaning member.

13. A cleaning device of an ink jet printing apparatus according to claim 11, wherein the first cleaning member and the second cleaning member have virtually equal shape dimensions.

14. A cleaning device of an ink jet printing apparatus according to claim 11, wherein the first cleaning member and the second cleaning member are made of elastic materials and formed into a shape of plate.

15. A cleaning device of an ink jet printing apparatus according to claim 14, wherein a thickness of the first cleaning member is set smaller than a thickness of the second cleaning member so that, even when the distance between the liquid nozzle-formed face of the print unit and the recording surface is changed, a wiping state of at least one of the wipe portions of the first cleaning member and the second cleaning member remains almost equal to a wiping state before the change of the distance.

16. A cleaning device of an ink jet printing apparatus according to claim 14, wherein a hardness of the first cleaning member is set smaller than a hardness of the second cleaning member so that, even when the distance between the liquid nozzle-formed face of the print unit and the recording surface is changed, a wiping state of at least one,of the wipe portions of the first cleaning member and the second cleaning member remains almost equal to a wiping state before the change of the distance.

17. A cleaning device of an ink jet printing apparatus according to claim 15 or 16, wherein factors representing the wiping state of the wipe portions of the first cleaning member and the second cleaning member include engagement pressures of the wipe portions, engagement angles of the wipe portions with respect to the liquid nozzle-formed face, and nip widths of the wipe portions.

18. A cleaning device of an ink jet printing apparatus according to claim 11, wherein the distance adjust mechanism includes a cam member for moving the liquid nozzle-formed face of the print unit toward and away from the recording surface as the cam member is pivoted.

19. A cleaning device of an ink jet printing apparatus according to claim 11, wherein the print unit has an electrothermal transducer for heating a liquid used for printing to eject it from the liquid nozzle-formed face.

20. A cleaning device of an ink jet printing apparatus according to claim 11, wherein the contact widths of the wipe portions of the first cleaning member and the second cleaning member are individually set based on the amount of substance adhering to the liquid nozzle-formed face of the print unit and on the distance between the liquid nozzle-formed face of the print unit and the recording surface in such a manner that a wiping state of at least one of the wipe portions of the first cleaning member and the second cleaning member differs from a wiping state of the other.

21. A cleaning device of an ink jet printing apparatus according to claim 20, wherein, when the amount of adhering substance is relatively small and the distance between the liquid nozzle-formed face of the print unit and the recording surface is relatively large, an engagement pressure of at least one of the wipe portions of the first cleaning member and the second cleaning member is set larger than an engagement pressure of the other.

22. A cleaning device of an ink jet printing apparatus according to claim 21, wherein the contact widths of the wipe portions of the first cleaning member and the second cleaning member are individually set based on a dye ink or a pigment ink adhering to the liquid nozzle-formed face of the print unit and on the distance between the liquid nozzle-formed face of the print unit and the recording surface in such a manner that a wiping state of at least one of the wipe portions of the first cleaning member and the second cleaning member differs from a wiping state of the other.

23. A cleaning device of an ink jet printing apparatus according to claim 22, wherein, when the pigment ink adheres to the liquid nozzle-formed face of the print unit, an engagement pressure of at least one of the wipe portions of the first cleaning member and the second cleaning member is set larger than an engagement pressure of the other.

24. An ink jet printing apparatus comprising:

a print means for ejecting ink from nozzles onto a recording medium for printing;

an ejection recovery means for recovering the ejection performance by engaging the print means;

a selector mechanism for selecting a distance between the print means and the recording medium during printing; and a cleaning means having a plurality of cleaning members, the cleaning members having different free end positions according to the distance between the print means and the recording medium, wherein a distance that the print means is moved by the selector mechanism and a height difference between the cleaning members are set almost equal.

25. An ink jet printing apparatus according to claim 24, wherein the free ends of the plurality of the cleaning members of the cleaning means are positioned so that when the distance between the print means and the recording medium is changed by the selector mechanism, forces of the cleaning members corresponding to the distance when the cleaning members engage with the print means are almost equal.

26. An ink jet printing apparatus according to claim 24, wherein the free ends of the plurality of the cleaning members of the cleaning means are positioned so that when the distance between the print means and the recording medium is changed by the selector mechanism, deflections of the cleaning members corresponding to the distance when the cleaning members engage with the print means are almost equal.

27. An ink jet printing apparatus according to claim 24, wherein the free ends of the plurality of the cleaning members of the cleaning means are positioned so that when the distance between the print means and the recording medium is changed by the selector mechanism, engagement angles of the cleaning members corresponding to the distance when the cleaning members engage with the print means are almost equal.

28. An ink jet printing apparatus according to claim 24, wherein the cleaning means has a plurality of the cleaning members with different lengths according to the distance between the print means and the recording medium.

29. An ink jet printing apparatus according to claim 24, wherein the cleaning means has a plurality of the cleaning members with different lengths and different thicknesses according to the distance between the print means and the recording medium.

30. An ink jet printing apparatus according to claim 24, wherein an absorbent body is arranged between the cleaning members.

31. An ink jet printing apparatus according to claim 24, wherein the cleaning members are arranged in a direction of movement of the print means and the cleaning member to be used is selected by the carriage position according to the distance between the print means and the recording medium.

32. An ink jet printing apparatus according to claim 24, wherein the selector mechanism selects between a first distance and a second distance, wherein the plurality of cleaning members includes first and second cleaning members corresponding to the first distance and the second distance, and wherein an engagement condition in which the first cleaning member engages the print means at the first distance is almost identical to an engagement condition in which the second cleaning member engages the print means at the second distance.

33. An ink jet printing apparatus according to claim 24, wherein the print means has an electrothermal transducer that generates thermal energy for ejecting ink.

* * * * *

UNITED STATES PATENT AND TRADEMARK OFFICE

CERTIFICATE OF CORRECTION

PATENT NO. : 6,530,642 B1
DATED : March 11, 2003
INVENTOR(S) : Uchikata et al.

It is certified that error appears in the above-identified patent and that said Letters Patent is hereby corrected as shown below:

Column 2,
Line 27, “this,” should read -- this --.

Column 14,
Line 51, “the,” should read -- the --.

Column 21,
Line 45, “print,head” should read -- print head --.

Column 22,
Line 52, “in,the” should read -- in the --.

Column 30,
Line 28, “one,of” should read -- one of --.

Signed and Sealed this

Ninth Day of December, 2003

JAMES E. ROGAN
*Director of the United States Patent and Trademark Office*